US006213045B1

(12) United States Patent
Gaber

(10) Patent No.: US 6,213,045 B1
(45) Date of Patent: Apr. 10, 2001

(54) FLOTATION SYSTEM AND METHOD FOR OFF-SHORE PLATFORM AND THE LIKE

(76) Inventor: Steve J. Gaber, 316 E. McLeod Road Rd., Bellingham, WA (US) 98226

( * ) Notice: Subject to any disclaimer, the term of this patent is extended or adjusted under 35 U.S.C. 154(b) by 0 days.

(21) Appl. No.: 09/415,138

(22) Filed: Oct. 8, 1999

Related U.S. Application Data

(63) Continuation of application No. 09/384,160, filed on Aug. 27, 1999, now abandoned.

(60) Provisional application No. 60/102,564, filed on Sep. 30, 1998, provisional application No. 60/102,393, filed on Sep. 29, 1998, provisional application No. 60/102,367, filed on Sep. 29, 1998, and provisional application No. 60/098,311, filed on Aug. 27, 1998.

(51) Int. Cl.[7] ..... B63B 35/44

(52) U.S. Cl. ..... 114/266

(58) Field of Search ..... 114/264, 265, 114/266; 405/195.1, 200, 203

(56) References Cited

U.S. PATENT DOCUMENTS

| | | | | |
|---|---|---|---|---|
| 2,552,899 | | 5/1951 | Manes . | |
| 3,572,041 | | 3/1971 | Graaf . | |
| 3,933,108 | | 1/1976 | Baugh . | |
| 3,949,693 | * | 4/1976 | Bauer et al. | 114/264 |
| 4,126,011 | | 11/1978 | Lamy et al. . | |
| 4,234,270 | | 11/1980 | Gjerde et al. . | |
| 4,310,052 | | 1/1982 | Rivertz . | |
| 4,422,803 | | 12/1983 | Wetmore . | |
| 4,702,648 | | 10/1987 | Stageboe et al. . | |
| 4,740,109 | | 4/1988 | Horton . | |
| 4,766,836 | | 8/1988 | Behar et al. . | |
| 5,038,702 | | 8/1991 | Bowes . | |
| 5,088,858 | * | 2/1992 | Massoudi | 405/203 |
| 5,375,550 | | 12/1994 | Innis . | |
| 5,435,262 | * | 7/1995 | Grinius et al. | 114/264 |

* cited by examiner

*Primary Examiner*—Stephen Avila
(74) *Attorney, Agent, or Firm*—Robert B. Hughes; Hughes & Schacht, PLLC

(57) ABSTRACT

A flotation assembly made up of a load bearing structure which can be an off-shore platform, and also a flotation section comprising a plurality of flotation tubes. Each of the flotation tubes comprises a surrounding side wall defining a vertically aligned elongate pressure chamber and having an upper end closure portion that has a downwardly facing surface exposed to pressure in the chamber. The tubes are positioned at laterally spaced locations and arranged relative to the load bearing structure so as to create upwardly directed flotation forces that bear against the load bearing structure. A source of pressurized gas is transmitted to the flotation tubes to a level where the gas pressure within each tube creates a force against the side walls to alleviate compressive force of the surrounding water pressing inwardly against the side walls of the flotation tubes. There are various arrangements of the flotation tubes, and these are provided in various forms, either with closed lower ends, open lower ends exposed to ambient pressure, etc.

89 Claims, 21 Drawing Sheets

FLOTATION SYSTEM AND METHOD FOR OFF-SHORE PLATFORM AND THE LIKE

RELATED APPLICATIONS

This present application is a Continuation Patent Application claiming priority benefit of U.S. Ser. No. 09/384,160 filed on Aug. 27, 1999, now abandoned, which is related to, based on, and claims priority from, Applicant's Provisional Applications S.N. 60/102,564 filed on Sep. 30, 1998, Ser. No. 60/102,393 filed on Sep. 29, 1998, Ser. No. 60/102,367 filed on Sep. 29, 1998, and Ser. No. 60/098,311 filed on Aug. 27, 1998.

FIELD OF THE INVENTION

The present invention relates to a flotation assembly, such as an off-shore floating platform or other structure, and also to a method related to the same. More particularly, the present invention relates to such an assembly and method where an auxiliary flotation support section or sections are provided for floating support to the assembly in a particularly effective manner.

1. Background of the Invention

For many years, the oil and gas industry has used off-shore fixed platforms resting on the sea floor, to drill and extract oil from under the ocean. More recently, the need to explore and produce in deeper waters requires the employment of floating platforms, since a fixed platform could not be designed for operation at those greater depths.

In many respects, the considerations and problems relating to the design, construction and operation of floating off-shore platforms are analogous to those of the design, building and operation of ships. Therefore, it was only natural that those who were engaged for the design of such floating platforms had a background in, or at least derived much of their information from, the ship building industry, particularly since there already exists a large body of design and fabrication expertise in that industry which would be directly applicable to the task of designing, constructing and operating floating platforms.

Thus, the current method of providing flotation for off-shore platforms is to construct a steel structure, commonly called a "hull", that displaces an amount of water equal to its own weight plus the pay load. Generally the upper support surface of the hull is located about 40 to 60 feet above the water level, and the hull would normally extend downwardly below the water surface from 100 to 200 feet. The hull must resist the external pressure of the water below the water line, and this is accomplished by using steel plates, reinforced as needed with internal ribs, stiffeners, bulkheads and bracing. Further, the entire structure must have sufficient structural strength to withstand the external loads imposed on them from the wind, waves, and possibly other sources.

2. Related Art

A search of the U.S. patent literature has disclosed a number of patents related to flotation support structures of various kinds, some of these being related to off-shore drilling, and these are the following:

U.S. Pat. No. 5,435,262 (Grinius et al.) discloses a semi-submersible off-shore platform comprising a hull having a plurality of stabilizer buoys. Each of the buoys is coupled to the hull and is positioned adjacent to the peripheral edge of the hull. There is a system for stabilizing the semi-submersible platform.

U.S. Pat. No. 4,422,803 (Wetmore) discloses an off-shore structure which has at least two similar prefabricated concrete modular subassemblies interconnected in a vertical manner to define a horizontal interface between each pair of subassemblies. There are vertically disposed sheer resistant pin means between the subassemblies and the cement at the interface to secure them together.

U.S. Pat. No. 2,552,899 (Manes), shows a "floating drilling rig" that is provided with tanks that provide flotation as it is moved to the drilling site.

U.S. Pat. No. 3,572,041 (Graaf) disclosed a spar type floating production facility for under water oil and gas wells. There is a spar section 13 which supports what is called a "super structure component 14" that is located above the water surface 16. The upper part of the spar section 13 consists of 6 large diameter, hollow vertical columns 101–106 which are interconnected by a large diameter, hollow grid 107 and a small diameter, hollow upper grid 108.

U.S. Pat. No. 4,126,011 (Lamy et al) relates to an off-shore tower structure, and deals primarily with the method of fabrication. It appears that there is a support structure adapted to rest on the bottom of the body of water and there is another member extending upwardly in the body of water. The platform is made up of two pieces which are floatable. The patent describes in detail the method for assembling and positioning the same.

U.S. Pat. No. 4,234,270 (Gjerde et al) shows a support element 6 of cells 10 that surround the upper end of the structure and holds the platform above the sea surface.

U.S. Pat. No. 4,310,052 (Rivertz) show an upright platform supporting member 7, that is provided with surrounding elements 6 that appear to serve as floats.

U.S. Pat. No. 4,702,648 (Stageboe et al) shows a platform structure in which there is an anchoring base 2, that rests on the sea floor. The upper, floating section which is also formed of joined cylinders is joined to the lower location by a tension element. The upper section is formed of relatively elongated cylinders, some of which are long enough to act as supports for the platform.

U.S. Pat. No. 4,740,109 (Horton) shows a compliant buoyant tower which is shown in FIG. 19, as being kept upright by a group of elongated cylinders 96, composed of tank like elements 98.

U.S. Pat. No. 4,766,836 (Behar et al) shows an off-shore tower which is formed of a central buoyant element and a series of tank elements secured around the central element. The outer elements are used for storage.

U.S. Pat. No. 5,038,702 (Bowes) shows what is called a "semi-submersible platform" which is supported on columns with pontoons extending between an outboard of the columns. This is provided with pitch stabilization and motion phase control devices such that when the platform is in the "drilling mode", the platform is able to ride with the storm waves.

U.S. Pat. No. 5,088,858 (Massoudi) relates primarily to a method of manufacturing and installing what is termed an "artificial island", such as a column, pile, harbor, and also a drilling platform capable of Withstanding icebergs, etc. There is a structure 1 having a polygonal construction which has a number of anchors 7. This is surrounded by what is called an "annulus" of pontoons 16. There is a detailed description of the method of installing this, and this can be summarized by reading claim 1, beginning on line 17 of column 10.

U.S. Pat. No. 5,375,550 (Innis) shows a floating platform where there is a plurality of cylindrical air filled platform modules, each having an open bottom end and a closed top end cap 18 of a square configuration. The trapped air chambers are interconnected to increase stabilization of the platform, and the caps 18 collectively provide the support platform.

U.S. Pat. No. 5,435,262 (Grinius et al.) shows a semi-submersible off-shore platform having stabilizer buoys 108 attached to the upper surface of the hull.

U.S. Pat. No. 3,933,108 (Baugh), shows a system for attaching floats to the riser. The purpose is to make the riser sections sufficiently buoyant to substantially reduce the need for tensioners or other similar apparatus for applying tension to the riser column.

SUMMARY OF THE INVENTION

It is long been recognized that the use of steel in the construction of off-shore platform hulls requires that a large mass of steel be used, thus producing a high weight-to-buoyancy ratio. In other words, many pounds of steel must be used to produce relatively few pounds of buoyancy. Thus, the hull must be sized to float not only the pay load but also to float itself.

Further, steel is prone to corrosion from the marine environment. In spite of coatings, and due to the need for cathodic protection, the maintenance costs of steel structures is high, adding significantly to life cycle cost. Accordingly, it is an object of the present invention to provide a flotation assembly which is particularly adapted for off-shore platforms and other such structures, which maintains the benefits of current design and construction of off-shore platform hulls and other such structures and yet which provide a lower weight-to-buoyancy ratio and other related benefits.

More specifically, the present invention enables the effective use of other materials, such as fiber reinforced plastic, that are more corrosion resistant in a marine environment. Further, embodiments of the present invention can provide reduced cost of construction and maintenance, thereby reducing the life cycle cost of operations. Further, in certain preferred embodiments the present invention can be engineered/designed/built using existing technology and construction practices and that can be implemented by use of multiple parts of the same size and design. Other objectives and advantages will be more apparent from a consideration of the following text and drawings.

In the design and operation of the present invention, the body of water in which the invention operates (i.e. the ocean or other body of water) can be considered as having a water surface, a "wave impact zone" which is adjacent to the water surface, a quiescent zone which at a greater depth, and an intermediate zone. In the wave impact zone, the hull or other flotation structure is subjected to various forces resulting from the ocean waves, the wind, or possibly other forces or impact forces placed on the structure. Depending on the location of the off-shore structure, in general, this wave impact zone could extend as much as 40 to 60 feet above the water level, measured at a time when the water surface is calm, and also as much as 30 to 50 feet below the water surface. However, within the broader scope, the ranges could vary from values of 80, 75, 70, 65, 60, 55, 50, 45, 40, 35, 30, 25, 20, or 15 feet, above and/or below the water, depending on the circumstances.

The quiescent zone is at a sufficient depth below the water surface so that even though the water is not totally unaffected by the wave action at the surface, such effect is minimal or nearly non-existent. This of course is dependent in large part on the height and depth of the wave impact zone. In general, for off-shore oil platforms the upper boundary of the quiescent zone would be at least as low as (or lower than) 50 feet below the water surface. However, depending on the circumstances, within the broader range this could vary from 20, 25, 30, 35, 40, 45, 50, 55, 60, 65, or 70 feet or greater.

Obviously there is no sharp line of demarcation between the wave impact zone and the quiescent zone, and so for purposes in establishing the positioning and operation of the components of the present invention, there can be considered to be the "intermediate zone" or what could be termed a "transition zone" where the wave impact zone makes the transition to the quiescent zone. This intermediate zone could be considered to be anywhere between 0 to 30 feet, and also at intermediate ranges of depth, for example 5, 10,15, 20, or 25 feet.

The flotation assembly of the present invention is adapted to be positioned in a body of water having a water surface. The assembly comprises:

a) a load bearing structure which is adapted to be positioned in an operating position at a support location at the body of water, with a load bearing structure having a support portion to support a load and a flotation support region at which a flotation lifting force or forces can be applied;

b) a flotation section comprising a plurality of flotation tubes, each of which has an upper end portion, a lower end portion, and a longitudinal axis which is aligned so as to have a substantial vertical alignment component;

c) each flotation tube comprising a surrounding side wall defining an elongate pressure chamber and an upper end closure portion having a downwardly facing pressure surface exposed to pressure in the pressure chamber, the tubes being positioned at laterally spaced locations and arranged relative to the load bearing structure in a manner that each upper end closure portion of at least some of the flotation tubes operatively direct flotation forces to the load bearing structure to create an upwardly directed bearing force against the load bearing structure;

d) a source of pressurized gaseous fluid to pressurize the flotation tubes to a level where gas pressure within each tube creates a force against the side wall to alleviate at least in part compressive force of surrounding water pressing inwardly against the side walls of the flotation tubes.

The flotation tubes are constructed and arranged to withstand forces created by pressure in the tube in hoop tension, with a bearing force exerted by each end closure portion of each tube being created by gaseous pressure in the related chamber against end portions of the tubes.

In one arrangement, the lower end portions of at least some of the flotation tubes are exposed to ambient pressure of water at the lower end portion of the tube to place at least a portion of the flotation tube above a location at which the flotation tube is open to water in hoop tension.

In another arrangement, the lower end portions of the at least a portion of the flotation tubes are at least partially closed, and there is an extension tube leading downwardly from the lower end portion and having a lower end of the extension tube being opened to ambient water pressure.

In another arrangement, at least one of the flotation tubes is closed at each end to isolate the interior of the chamber of such tube from communication with the ambient water pressure. In this arrangement, the tube that is closed at both ends is pressurized to a sufficiently high level so that the tube that is closed at both ends is in hoop tension and also in axial tension to alleviate radially inward compressive loads and axial compression loads.

In a preferred form, the source of pressurized gaseous fluid is arranged to pressurize the flotation tubes to a level at least as great as or greater than the water surrounding at least a substantial portion of a substantial number of the flotation tubes to place each of said substantial portion of said tubes in hoop tension along a substantial portion of each flotation tube.

In a preferred embodiment, a load support portion of the load bearing structure comprises a load supporting platform having an upwardly facing support surface. In a specific version of this embodiment, the load supporting platform comprises a hull structure which in an operating position of the assembly in the water is positioned at the water surface and at least in part in a wave impact zone at the water surface. The hull structure further comprises a flotation structure which in the operating position is at least in part below the water surface to provide a buoyancy force in the operating position and having sufficient structural integrity to withstand wave action and/or other external forces enclosed thereon when in the operating position. In at least one arrangement, at least some of the tubes are positioned at circumferentially spaced locations around the hull structure, with upper ends of some of the tubes being in load bearing relationship to the structure that is positioned at circumferential locations around the hull structure to transfer buoyancy forces from some of said tubes to the hull structure.

In another version the flotation tubes comprise an auxiliary flotation section below the hull structure with at least a substantial portion of the auxiliary support section positioned below the wave impact zone when the assembly is in the operating position. The upper end closure portions of the tubes are an operative bearing engagement with a lower portion of the hull structure.

In yet another arrangement, the flotation tubes are arranged in at least two groups of said flotation tubes. There is a first upper group positioned beneath the load bearing structure to be in load bearing relationship therewith, and a second group of flotation tubes being positioned below the first group of flotation tubes, with each group of the flotation tubes exerting a buoyant force to maintain the hull structure in its operating position. In one arrangement, the load bearing structure is hull structure having a flotation section which is in an operating location beneath the water surface, and the upper group of tubes is positioned below the hull structure.

In another arrangement of the above embodiment, the upper portion of the tubes of the first group extend above the water surface and engage the load bearing structure which is above the water surface. In one arrangement of this, the tubes of the first group are pressurized to a sufficiently high level so that the tubes of the first group are not subjected to axial compression loads from the load bearing structure. In another arrangement, the lower ends of the tubes of the first group are open to ambient water pressure with the tubes of the first group withstanding loads from the load bearing structure at least in part in compression loading.

In another arrangement where there is a first and second group of tubes, at least some of the flotation tubes of the first group and from the second group are in direct load bearing relationship, with some of the second group of flotation tubes being in load bearing relationship against related aligned flotation tubes of the first group. Thus the buoyancy force from at least some of the flotation tubes in the second group is directed to the aligned flotation tubes there above and to the hull structure.

In another arrangement where there are the first and second groups of flotation tubes, the flotation tubes from the first group that are in alignment with some of the flotation tubes of the second group have lower end portions thereof open to pressure of ambient water, and the flotation tubes of the first group that are in such alignment are constructed and arranged to bear compression loads between the hull structure and the aligned flotation tubes of the second group.

In a preferred form of the present invention, at least some of the flotation tubes are pressurized to a level so that their side walls are in hoop tension, with the force of the hoop tension increasing with the level of the portion of the flotation tubes in the water. The side wall of each of said tubes in hoop tension is constructed so that an upper portion of the flotation tubes in hoop tension have greater resistive strength in hoop tension relative to the lower part of the flotation tube that is in hoop tension.

A preferred form of the present invention is that the flotation tubes are in hoop tension are constructed of fiberglass, and the fiberglass in arranged relative to the material strength, and/or quantity of material in a manner to accomplish greater resistance to hoop tension at upper elevations of the fiberglass flotation tubes than at lower levels of said fiberglass said flotation tubes.

In one arrangement, the flotation assembly comprises an off-shore platform which comprises a flotation hull that extends above the water surface and also extends above the water surface and also extends below the water surface. The hull in its operating portion is at least 20 feet above the water surface and extends at least 20 feet below the water surface.

Also, in a preferred embodiment the assembly comprises a hull structure which is supported at least in part by the flotation force in the water which has a central opening. The load bearing structure is positioned within the central opening of the hull structure and is able to move axially relative to the hull structure. A drill string or other equipment could be supported from this load bearing structure. Thus the flotation tubes, being in load bearing relationship with the load bearing structure, are able to move with the load bearing structure axially, relative to the hull structure. In a specific form of this embodiment, there are additional flotation tubes located beneath the hull structure, and these are in load bearing relationship with support structure that is in turn connected to the load bearing structure and thus transmit buoyant forces to the load bearing structure.

In another embodiment, there is a plurality of groups of flotation tubes, vertically aligned with one another and spaced vertically from one another. A load transfer structure extends vertically form the load bearing structure downwardly. The load transfer structure has vertically spaced load transfer sections, each of which engages upper end portions of a related group of the tubes. Thus buoyancy forces of each group of tubes is transmitted into related load transfer sections into the load transfer structure and to the load bearing structure.

It is presently contemplated that the satisfactory flotation tube could be constructed in accordance with the teachings of the present invention where the tube would have a 12 foot diameter, and could be as long as 100 feet in length. The side wall could be a conventional construction and could be made 1 inch thickness. The cap also could be made by conventional fiberglass construction and have a thickness at about 1½ inches. Within the broader scope, the diameter and/or the length of the tube and/or thickness of the tube wall could be increased by 10 percent, 25 percent, 50 percent, 75 percent, 100 percent, 150 percent, 200 percent, 300 percent, 400 percent or 500 percent. Also these could be decreased by 10 percent, 20 percent, 30 percent, 40 percent, 50 percent 60 percent, 80 percent and 90 percent. Also, the thickness of the side wall of the tubes could be increased by increments of one-tenth of an inch up to any desired level up to a maximum of five inches, and could be decreased by increments of one-tenth of an inch of thickness of 0.1 inch.

The fiberglass strands would commonly be oriented at about 60–75 degrees relative to the longitudinal center axis of the tube, and this range could be broadened to 55 degrees to 80 degrees, 50 degrees to 85 degrees, and 45 degrees to 90 degrees. Or this angle could be down to 40 degrees, 35 degrees, 30 degrees, 25 degrees, 20 degrees, 15 degrees, 10 degrees, 5 degrees or 0 degrees.

In the method of the present invention, the auxiliary flotation support is provided to the load bearing structure by positioning the load bearing structure in the body of water. This load bearing structure has a support portion to support a load and a flotation support region at which a flotation lifting force or forces can be applied. The method further provides providing a flotation section, as described above, comprising a plurality of flotation tubes. Also as described above, the flotation tubes are placed in position at laterally spaced locations so as to direct flotation forces thereof to the load bearing structure to proved flotation support.

The method further comprises operating a source of pressurized gaseous fluid to pressurize the flotation tubes, as described above, to obtain the desired amount and distribution of the flotation forces. The flotation tubes being constructed and arranged to withstand the forces created by pressure in the tubes in hoop tension.

Other features of the present invention will be apparent from the following detailed description.

DESCRIPTION OF THE PREFERRED EMBODIMENTS

Figure 1:
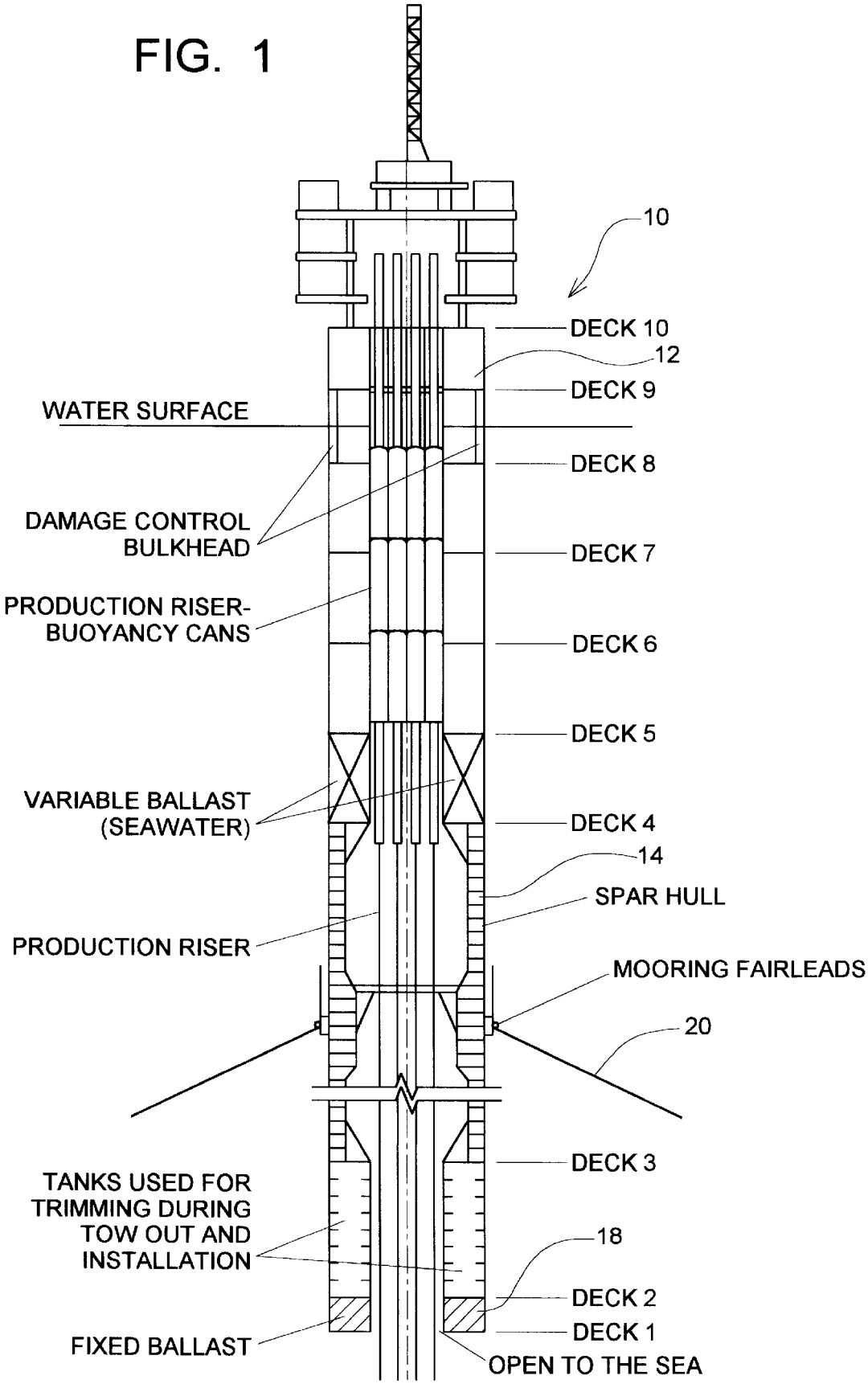
FIG. 1 is a side elevational view of a prior art off-shore platform assembly having a SPAR configuration.

In FIG. 1, there is shown a typical prior art off-shore platform assembly as a SPAR 10. It can be seen that there is a buoyant hull structure 12 and a cylindrical section 14 of the SPAR connected to the lower part of the hull structure 12 and extended downwardly therefrom. The cylindrical section 14 extends several hundred feet (e.g. 500 or more feet or as great as 700 to 900 feet) downwardly from the hull section 12. At the lower end of the cylindrical section 14, there is a ballast portion 18.

A typical construction of the hull structure 12 is that it would have in plan view a circular configuration having a circular center opening. The top surface of the hull structure 12 provides an upper deck or support surface for the equipment, machinery and other structures. The hull structure 12 is made with plate steel and is compartmentalized, along with various bracing, support beams, etc. The structure 12 is made sufficiently rugged and strong to withstand the various forces of the wind, waves and possibly other external forces, and has enough volume so as to create sufficient buoyancy to support not only its own weight, but that of the rest of the SPAR 10 and the various items placed on, or supported from, the SPAR 10.

Typically, a drill string and possibly other items or equipment would extend through the center opening of the hull structure 12, and the drill string sections and other items would be lowered through the center opening of the hull structure 12 to a lower location and also raised from the lower location upwardly through the sea water and then through the center opening of the hull structure 21. There are shown several anchor lines 20 which extend from the spar downwardly and outwardly to anchoring locations in the ocean floor.

Figure 2:
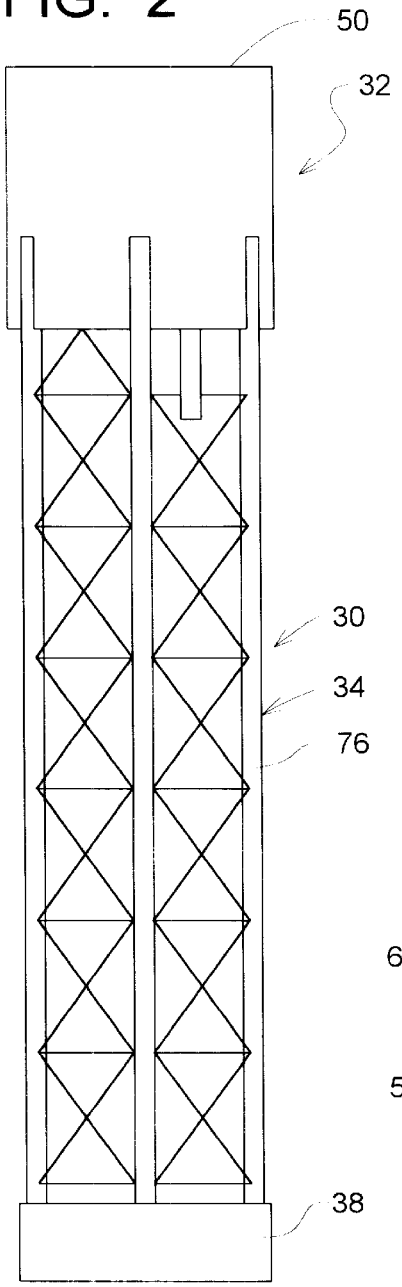
FIG. 2 is a side elevational view similar to FIG. 1, but showing the off-shore platform assembly incorporating the present invention.

Reference is first made to FIG. 2, which shows a first embodiment of the present invention, incorporated in a SPAR assembly 30. In this particular embodiment, the SPAR assembly 30 comprises a flotation section 32 and a truss section 34 which is attached to the lower side of the flotation section and to section 32 and extends downwardly therefrom. The truss section 34 may, in and of itself, be of conventional design. Thus, as shown herein the truss section 34 which is arranged to extend downwardly to a lower level, where it is attached to the ballast section 38.

Figure 3:
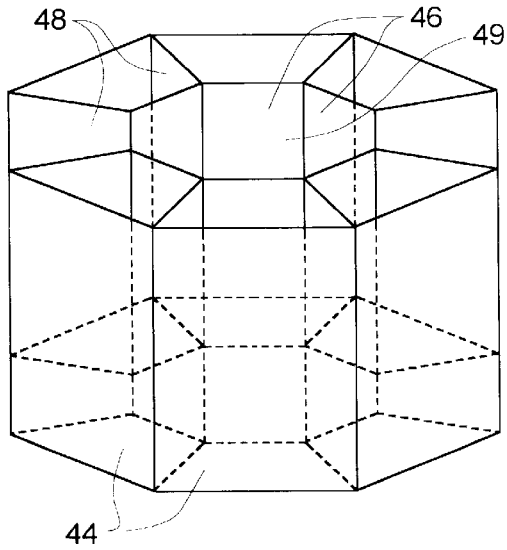
FIG. 3 is an isometric view showing somewhat schematically the structure of the hull section of FIG. 2.
Figure 5:
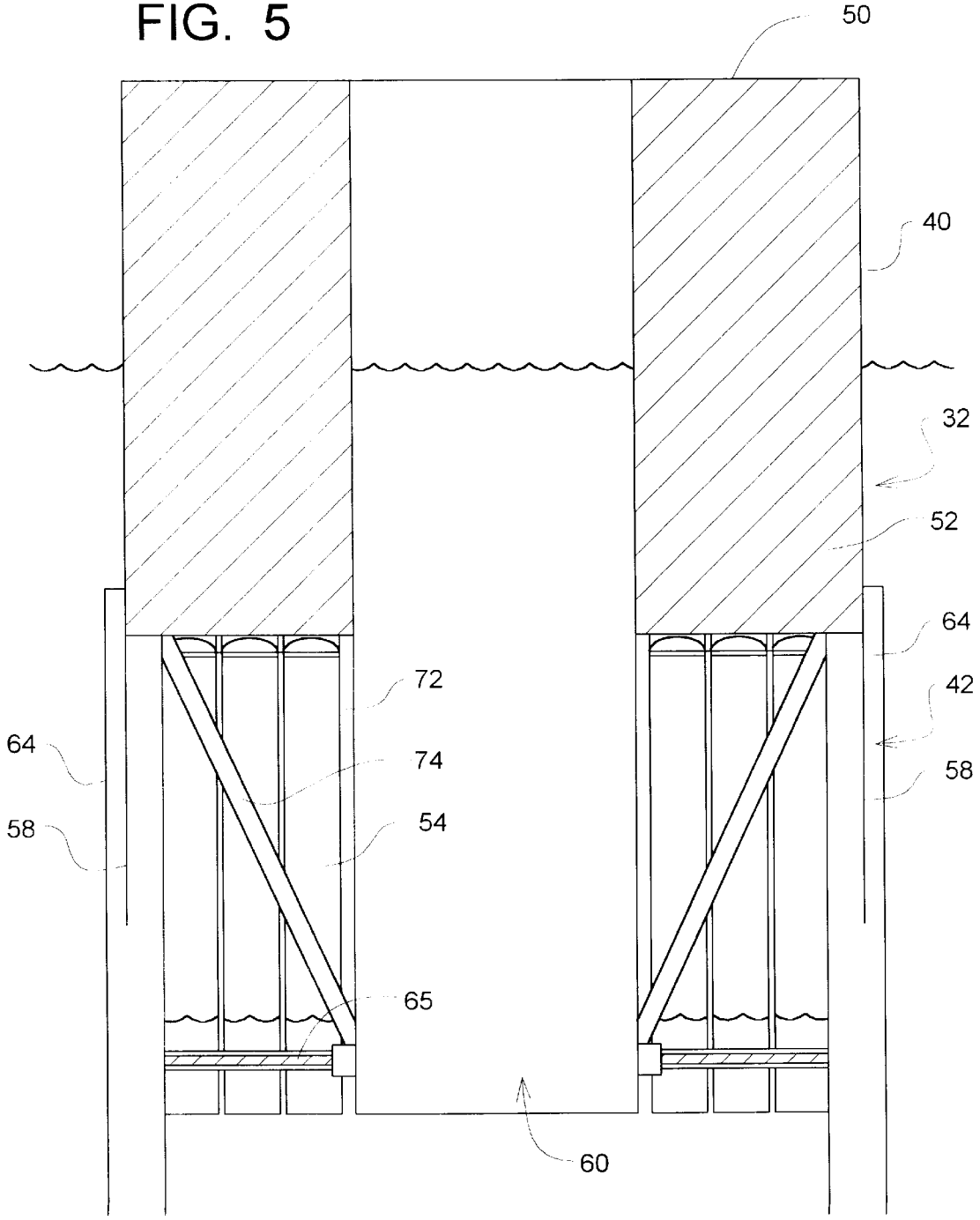
FIG. 5 sectional view taken along the longitudinal center line of the assembly of FIG. 2, and showing the flotation section which comprises the hull section and the auxiliary flotation section.

As shown in FIG. 5, the flotation section 32 is in turn made up of a hull structure 40 and also an auxiliary flotation section 42. The basic construction of the hull structure 40 is, or may be, substantially similar to the prior art hull structure. One such construction is shown somewhat schematically in FIG. 3, where for purposes of illustration the various plates are shown as being somewhat transparent. It can be seen that there are a plurality of outer side plates 44 arranged (as seen in plan view) in a polygonal or circular shape. There are also inside vertical wall plates 46 also arranged generally in the shape of a circle or a regular polygon. Then there is a plurality of radially extending vertical plates 48 interconnected to juncture points of the inner plates 46 and outwardly to juncture points of the outer plates 44. This provides for the compartmentalized construction. In addition, as is done in the prior art, there would likely be various additional structural members such as reinforcing beams, etc. Also the hull structure 40 is provided with a center through opening 49.

The hull structure 40 in the present invention differs from the prior art in that the overall volume of the hull structure 40 relative to the overall flotation capability of the flotation section 32 is much smaller. However, the overall construction of the flotation section 32 is such that the upper support surface 50 would be at approximately the same distance above the sea water as a comparable prior art flotation platform assembly, and the upper surface 50 would have a comparable area. However the bottom portion 52 of the hull structure 40 would be, in the operating position of the platform assembly 30, at a lesser depth beneath the water surface.

Figure 4:
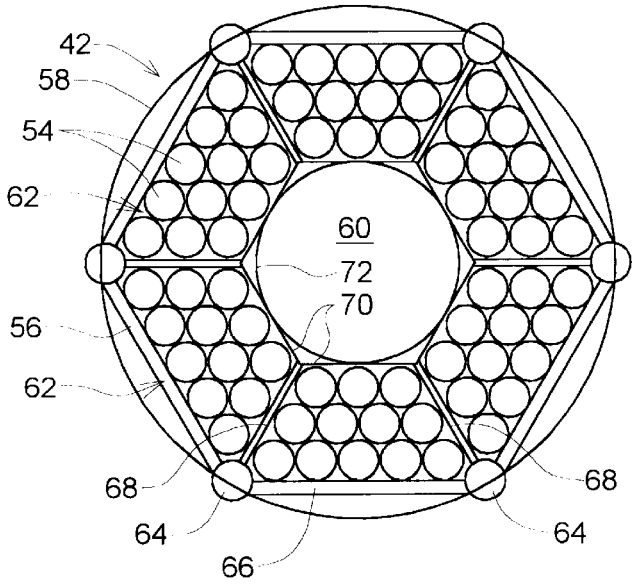
FIG. 4 is a transverse sectional view, taken in horizontal section, of the auxiliary flotation support section of the present invention, as shown in FIG. 2, drawn to a larger scale than in FIG. 2.

The additional buoyancy of the flotation section 32 is provided by the auxiliary flotation section 42 which is shown in a horizontal sectional view in FIG. 4 and also shown in the vertical cross section in FIG. 5. The auxiliary flotation section 42 comprises a plurality of vertically oriented flotation tubes 54 which are maintained in their proper operating position by means of a positioning framework 56. Also, there is provided a circumferential protective flotation shell or shroud 58 which extends in a cylindrical configuration circumferentially around the flotation tubes 54. The arrangement of the flotation tubes 54 is in a generally annular pattern, generally matching the plan view configuration of the hull structure 40. Thus, there is a central opening 60 in the flotation section 42 aligned with the opening 49 of the hull structure 40.

In the particular configuration shown in FIG. 4, the flotation tubes 54 are arranged in six groups 62, with each group having twelve flotation tubes 54. In this arrangement the tubes 54 are arranged in three rows of 3, 4 and 5 tubes 54. The positioning framework 56 comprises in this configuration 6 vertical columns or posts 64, each having a tubular configuration and each being a structural load bearing member. At the upper and lower ends of each column 64 there is a positioning structure 65, only one of which is shown in FIG. 5, with each comprising six horizontally aligned arms 66, arranged in a hexagon, with each arm 66 extending between two related columns 64. Then there are 6 radially aligned positioning members 68 extending inwardly from its related post 64 to join to a related pair of inwardly positioned arms 70 which are arranged in a hexagonal configuration around the central opening 60. It can be seen that each pair of an inner arm 70 and an outer arm 66 forms with their two related radial members 68 a regular trapezoid. Positioned within the arms 70, there is an interior shroud 72 having a cylindrical configuration. This shroud 72 has a protective function in that it prevents equipment or various objects that might drop downwardly through the opening 60 from coming into contact with the inner most set of tubes 54. All of the structural components are desirably hollow, and these are sealed to provide buoyancy.

Also as seen in FIG. 5, there can be diagonal cross braces such as shown at 74. As another option to maintain the tubes 54 in each set in proper spaced relationships, instead of or in addition to the frame sections 65, there can be positioned upper and lower positioning plates (not shown), with each plate being a planer member having circular cut-outs, with each cut-out, accommodating a related tube 54.

Each of the posts 64 can serve as the structural connecting member between the truss section vertical structure members 76 (see FIG. 2). As shown in FIG. 4, each column 64 is positioned so that it intersects the outer jacket or shell or shroud 58, and the shroud 58 could be formed with cutouts in which the columnar members 64 are positioned.

Figure 6:
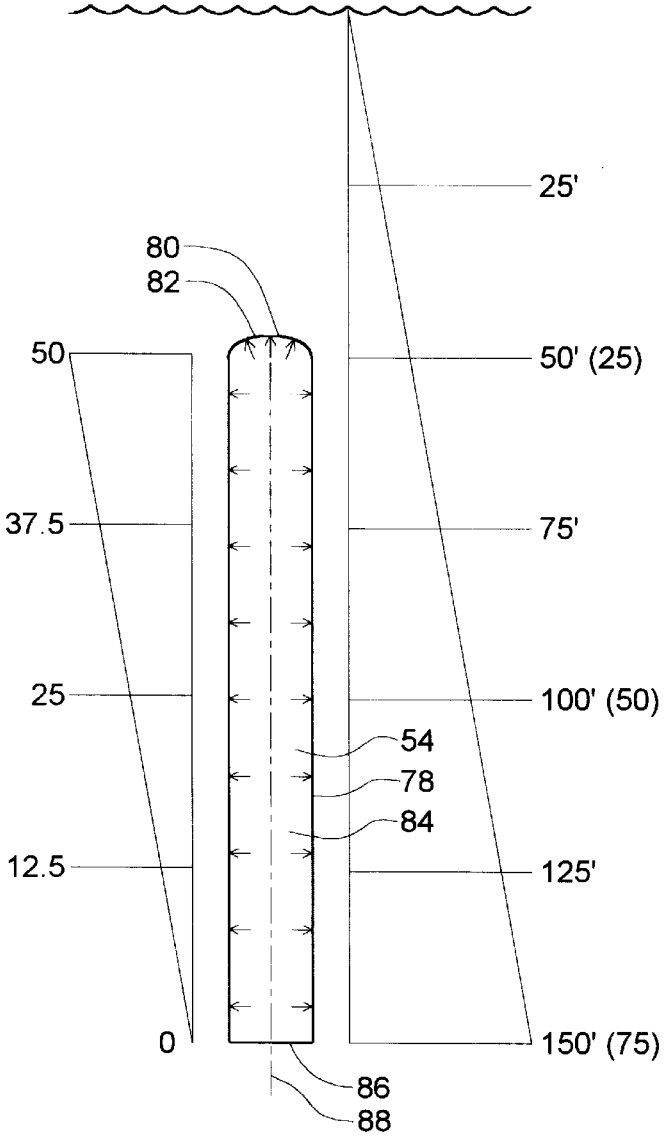
FIG. 6 is a somewhat schematic view illustrating a single flotation tube and showing graphically the water pressure at various depths from the top of the tube to the bottom of the tube, and also showing the pressure differential between the air pressure within the flotation tube and surrounding water pressure.

To describe now the structure and function of the flotation tubes 54, reference is initially made to FIG. 6, and then to FIGS. 6A–6G. FIG. 6 shows the tube 54 somewhat schematically, and this tube 54 comprises a cylindrical side wall 78 and an upper end cap 80 that has a rounded configuration which forms an upwardly facing convex surface 82. The side wall 78 and the end cap 80 form an interior pressure chamber 84 which in the particular arrangement of FIG. 6 has an open lower end at 86.

The tube 54 is pressurized so that water in the chamber 84 is displaced to a lower level. To describe the structure and function of the tube 54, let us assume that the tube 54 has a length of 100 feet, and that the upper end cap 82 is about 50 feet below the water surface. Let us also assume (for the sake of simplicity) that the water pressure increases 0.5 pounds for each foot of depth. Thus, in the arrangement of FIG. 6, at the level 50 feet below the surface, the water pressure is 25 pounds per square inch, at the 100-foot level 50 pounds per square inch, and at the 150 foot level, 75 pounds per square inch. Thus, if all of the water in the tube chamber 84 is to be displaced, the air pressure in the chamber must be at the 75 psi level.

In actual practice, the pressure will be somewhat less so that the level of the water is a moderate distance (e.g. 2–7 feet) upwardly from the bottom end opening 86. However, assuming that the air pressure is such that the water level is right at the bottom opening 86, it will be seen that the pressure differential at the opening 86 from the outside water and the air on the inside would be zero. At the 125 foot level, there would be a pressure differential of 12.5 psi (with the pressure within the chamber 84 being 75 psi and the outside water pressure being 62.5 psi. At the 100-foot depth level, this pressure differential will have raised to 25 psi, and at the location of the end cap 82, the pressure differential will be about 50 psi.

If we assume the interior diameter of the tube 54 to be 12 feet, then the cross-sectional area in a section extending horizontally through the tube 54 would be 16,278 square inches. With the pressure differential at the location of the cap 80 being 50 psi, it can be seen that the total force exerted by the air pressure upwardly against the cap 82 is 813,888 pounds. Each tube 54 is positioned so that its end cap 80 presses upwardly in bearing relationship against the hull structure 40, thus providing the buoyancy force for the hull structure 40.

Let us now examine how these various forces are reacted into the tube 54. Since pressure acts perpendicular to the surface with which the pressurized medium is in contact, it can be seen that the air pressure within the air chamber 84 reacts laterally outwardly against the tube side wall 78. Further, since the tube side wall 78 has a circular cross-sectional configuration, the pressure is exerted radially outwardly to place the side wall 78 in hoop tension. If we again assume that the interior diameter of the side wall 78 is 12 feet, and if we make a further assumption that the thickness of the side wall 78 is two inches, and further if we assume that the maximum pressure differential is 50 psi at the 50 foot depth, then the maximum tension load that would be placed upon each square inch of the material forming the side wall 78 would be about 3,600 pounds. Obviously, at greater depths where the pressure differential between the chamber 80 and the immediately adjacent water becomes less, this force would decrease proportionately.

It is also readily apparent that in this particular arrangement there are substantially no axial loads imposed on the side wall 78 (i.e. either tension loads or compression loads that would be parallel to the vertical axis 88 of the tube 78.

When one considers the types of loads which are imposed on each of the tubes 54, it can then be realized that the tubes 54 lend themselves particularly to being made of fiber reinforced plastic (FRP). The fibers in the side wall 78 can be oriented so as to have a substantial circumferential alignment component to better withstand the hoop tension. In theory, if the only loads that were imposed upon the tube 54 were those resulting from the tube 54 being pressurized, the side wall 78 could be made rather thin, and the lower end very thin. However, for practical reasons (manufacturing, shipping, withstanding occasional impacts from whatever source, etc.) the side wall 78 would be made somewhat thicker than what would be required to withstand the hoop tension loads.

Reference is now made to FIGS. 6A–6G to illustrate a number of different possible configurations of the tube 54. The components of these tube configurations shown in FIGS. 6A–6G will be given numerical designation corresponding to those in FIG. 6, but with a letter suffix (either letter a,b,c, etc.), being used to differentiate those shown in FIGS. 6A–6G.

Figure 6A:
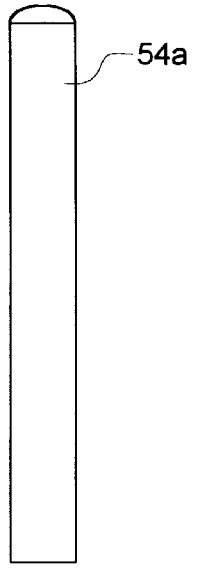
FIGS. 6A–6G show various arrangements and configurations of the flotation tube.
Figure 6B:
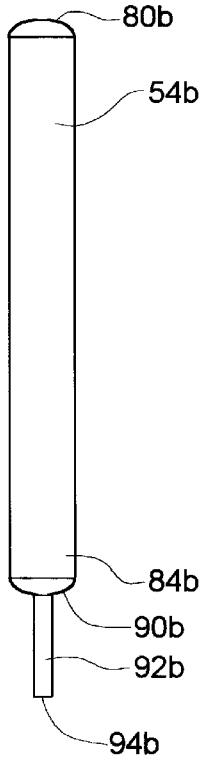

It can be seen that the tube 54*a* of FIG. 6A has the very same configuration as the tube in FIG. 6. Accordingly, there will be no further description of this tube 54*a*. In FIG. 6B, the tube 54*b* has the same overall configuration of the tube 54*a*, except that a lower end cap 90*b* is added, and also an extension tube 92*b* extends downwardly from the bottom cap 90*b*. This tube 92*b* is open at the bottom and leads into the lower end of the interior chamber 84*b*.

The reason for having this lower end cap 90*b* and the extension tube 92*b* is so that the lower end opening 94*b* is a further distance beneath the water level. Thus, if the pressure in the chamber 84*b* is sufficiently great to push the water level downwardly below the lower end of the main tube side wall 78 as when the structure bobs up and down in a storm, then the air will not escape, but will simply move periodically to a lower level in the tube 92*b*.

Figure 6C:
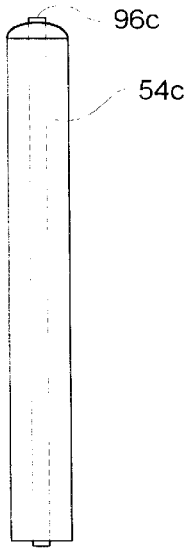

The tube 54*c* of FIG. 6C differs from the tube 54*a* only in that it is formed with a central tubular member 96*c* which extends the entire length of the tube 54*c* and is open at both the top and the bottom. When the tube 54*c* is pressurized, this tubular member 96*c* would feel a compression load directed radially inwardly. The reason for having this open tube 96*c* is that for some reason it may be desirable to have a member extend from the hull structure 40 to a downward location through this tubular member 96*c*.

Figure 6D:
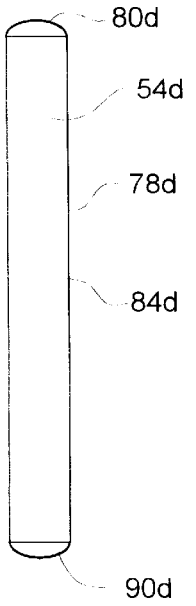

FIG. 6D shows a tube 54*d* that has the upper cap 80*d* and also a lower cap 90*b* which is closed. By having the tube 54*d* totally closed, this tube 54*d* can be pressurized to a higher pressure level than would be possible with the tube configurations of 6A, 6B and 6C. In some situations, it may be desirable to pressurize the chamber 84*d* to a higher level to place the side wall 78 in tension along the vertical axis. For example, with the side wall 78 in axial tension loading, the effective structural rigidity of the side wall 78 would be increased. Further, if for some reason loads were placed on the end caps 80*d* and 90*d* to place an axial compression load on the tube 54*d*, the side wall 78*d* would be alleviated from such compression load because of the greater axial force exerted by the two end caps 80D and 90D.

Figure 6E:
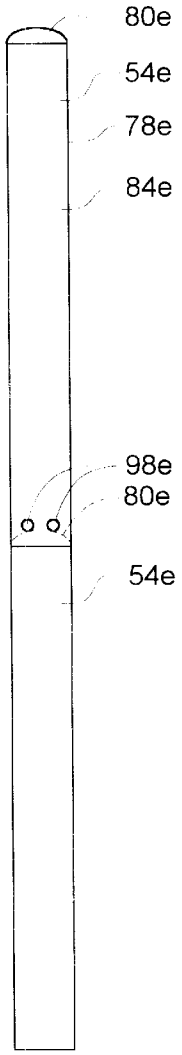

In FIG. 6E, there is shown two tubes 54*e* that are positioned one on top of the other. Each of these tubes 54*e* has an upper end cap 80*e*. It will be noted that the upper tube 54*e* has a pair of vent openings 98*e* at its lower end to permit water to flow inwardly and outwardly from the interior chamber 84*e*.

In the arrangement as shown in FIG. 6E, the end cap 80*e* of the lower flotation tube 54*e* will be exerting an upward force which would in turn be transmitted into the side wall 78*e* of the upper tube 54*e*. Thus, in this particular arrangement, the upper side wall 78*e* would need to be constructed so as to take axial compression loads, in addition to withstanding the loads in hoop tension. For this reason the upper tube may desirably be made of steel or other material better adapted to take compression loads.

Figure 6F:
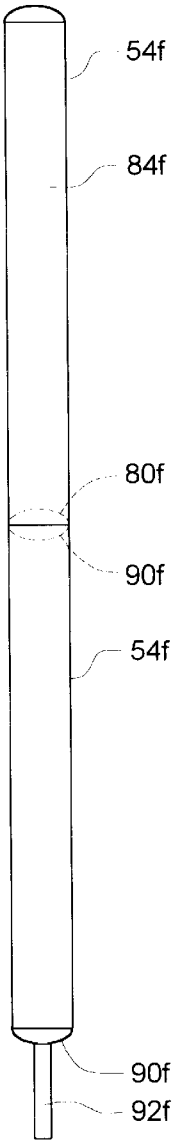

In the configuration of FIG. 6F, there are also two tubes 54*f* positioned one above the other. In one arrangement the two tubes 54*f* function in substantially the same manner as the two tubes 54*e*. However, the lower tube 54*f* has the lower cap 90*f* with the extension tube 92*f*. Further, it will be noted there is shown in broken line an upper cap 80*f* that is positioned at the upper end of the lower tube 54*f*. In that arrangement, the upper tube 54*f* functions in the same manner as the upper tube 54*e* and would withstand axial compression loads from the lower tube 54*f*.

However, in an alternative configuration, the upper tube 54*f* would have the configuration of the tube 54*d* of FIG. 6D so that the upper tube 54*f* would have a lower end cap 90*f* that would actually curve convexly into the upper end of the lower tube 54*f*, with the end cap 80*f* being eliminated. The upper end of the lower tube 54*f* would, in this arrangement, be sealed by its own upper end cap which would extend concavely into its inner chamber 78*f* so as to provide an air seal. In this instance, the lower tube 54*f* would be pressurized to a sufficiently high level to withstand the surrounding water pressure. The upper tube 54*f* would be pressurized to a pressure level at least as great as the lower tube 54*f*, or pressurized to a higher level to ensure that the side wall 78*f* would not be subjected to axial compression loads, but only axial tension loads.

However if the pressure in the upper tube 54*f* is only slightly higher than the air pressure in the lower tube 54*f*, the upper tube 78*f* would carry only moderate axial compression loads. There would, of course, need to be an airtight seal at the joining location of the upper and lower tubes 54*f*.

Figure 6G:
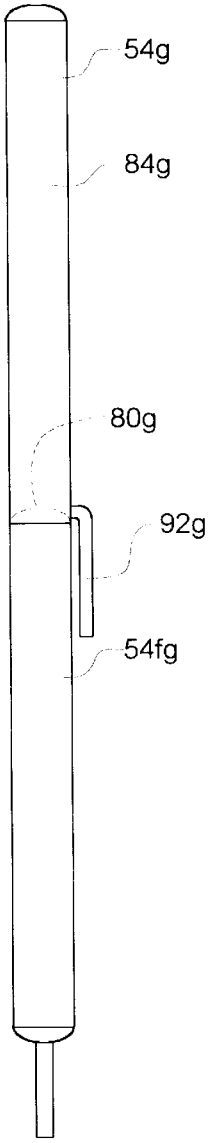

FIG. 6G shows substantially the same configuration as in FIG. 6F, except that there is provided an upper extension tube 92*g* which communicates with the lower part of the upper chamber 84*f*. Thus, the arrangement in FIG. 6G would function in substantially the same manner as in the arrangement of FIG. 6F, where the upper cap 80F is provided. Also, as with the arrangement of FIG. 6E, the upper tube 54*g* would be made of steel or some other material to better withstand the axial compression loads.

Reference is now made to FIGS. 7A, 7B, 7C and 7D to describe several ways in which the tubes 54 could be placed in bearing engagement against the hull structure 40.

Figure 7A:
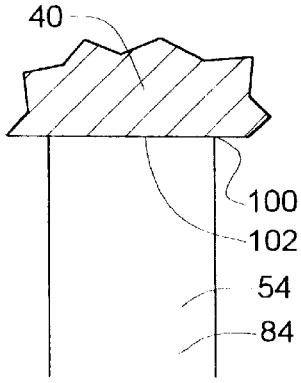
FIGS. 7A, 7B, and 7C and 7D show a flotation tube with four different methods of providing the operative engagement with the hull structure.

In FIG. 7A, the tube 54 is shown with its upper edge portion 100 fixedly connected (e.g. by bonding, welding, etc.) to a lower surface 102 of the hull structure 40. In this instance, there is no upper cover cap 80, and the air pressure within the chamber 84 bears against the hull structure surface portion 102.

Figure 7B:
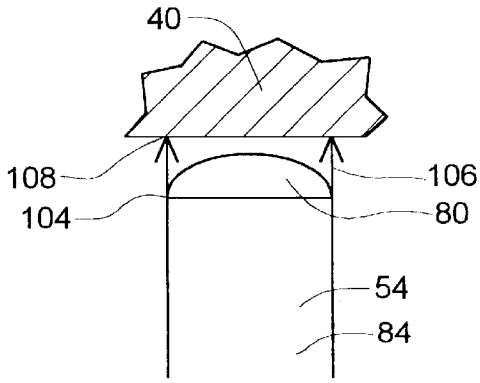

In FIG. 7B, there is shown the flotation tube 54 having the cover cap 80, and the circumferential edge 104 of the cover cap 80 is configured so as to have sufficient strength to be able to carry the bearing load of the tube 54. In this configuration, there is cylindrical member 106 which extends around the circumference of the cap 80 and the lower edge of the cylindrical bearing member 106 is pressed against the circumferential load bearing portion 104 of the cap 80. The upper edge 108 of the bearing member 106 is in engagement with the hull structure 40, and two small arrows are placed at the edge portion 108 to indicate the upward force exerted by the bearing member 106. Thus, the pressurized air in the tube chamber 84 urges the cap 80 upwardly, and the force created by the pressure against the cap 80 is reacted into its peripheral bearing portion 104 which in turn transmits the load through the cylindrical member 106 to the hull structure 40.

Figure 7C:
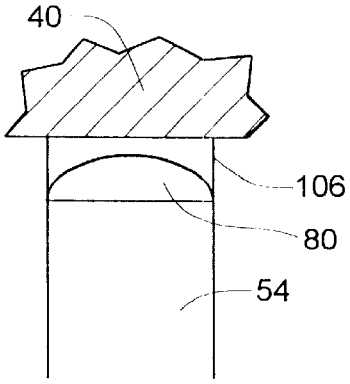

FIG. 7C shows a third arrangement where the tube 54 has the cap 80, and there is also the cylindrical bearing member 106. In this instance, however, the cylindrical bearing member is fixably attached to the hull structure 40, either by bonding, welding or some other means.

Figure 7D:
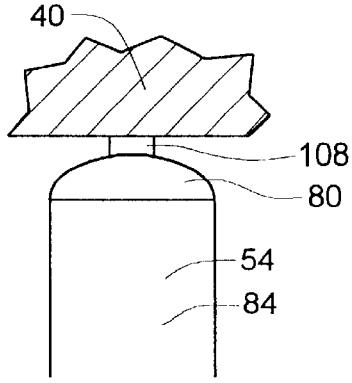

FIG. 7D shows yet a fourth arrangement where the tube 54 has the cap 80, but the bearing member 108 is positioned at an upper central location on the cap 80 so as to distribute the force exerted against the cap 80 upwardly at the central location against the hull structure 40. In this instance, the cap 80 has to be as sufficient structural strength to be able to transmit the force loads from the air pressure on the outer portions of the cap 80 through the structure of the cap 80 to the bearing member 110.

Figure 8A:
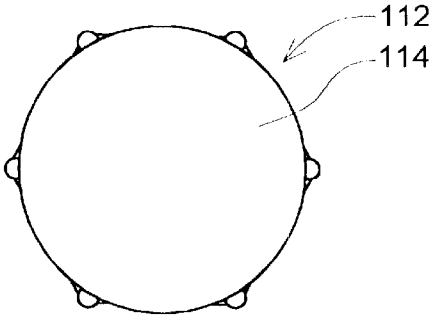
FIG. 8A is a top plan view of a flotation module.
Figure 8B:
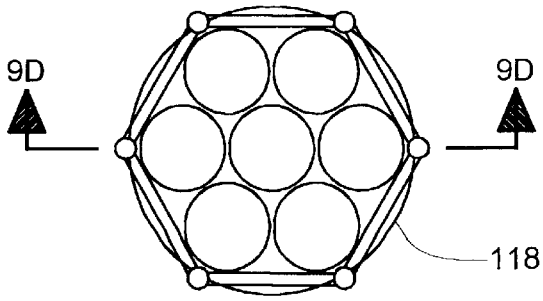
FIG. 8B is a top view of the flotation module FIG. 8A, but with the top bearing member not shown.

Reference is now made to FIGS. 8A–B and also FIGS. 9A–D which show an arrangement where a number of the flotation tubes 54 can be provided in the form of a flotation module 112.

The flotation module has four components, namely a top bearing member 114, a positioning frame 116 which is attached at its upper end to the bearing plate 114 and extends downwardly therefrom to encircle the tubes 54, and a surrounding shroud 118.

Figure 9A:
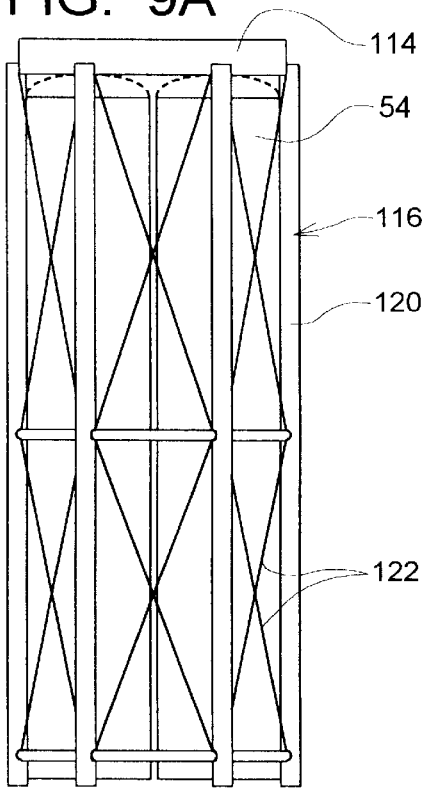
FIG. 9A is a side elevational view of the modular FIG. 8A, but with the surrounding shroud removed.

In FIG. 8A (a plan view) the module 110 is shown with the shroud 118, but in FIG. 9A, a side elevational view, the module 110 is shown without the shroud 118. In this particular configuration, the upper bearing member 114 is in the form of a circular structure that forms a plate. Alternatively, this bearing member 114 could be formed as an upper bearing frame made up of beams, cross members and other reinforcing (i.e. hull structure).

Figure 9B:
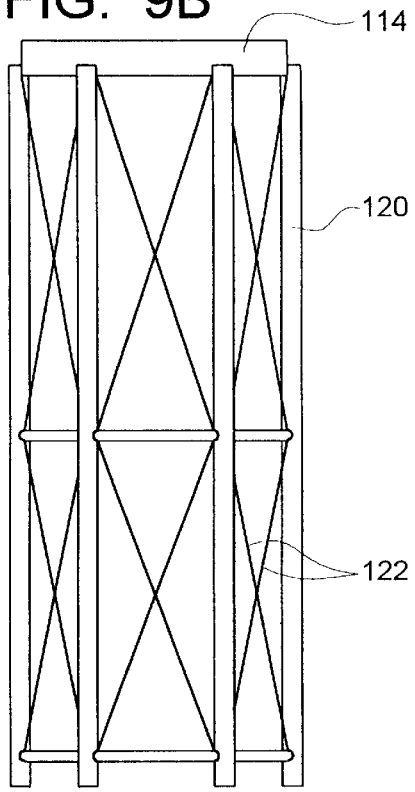
FIG. 9B is a side elevational view as in FIG. 9A, but with the flotation tubes not being shown.

The positioning frame 116 is shown in FIG. 9A with the tubes 54 positioned therein, and in FIG. 9B the positioning frame is shown without the tubes 54. This positioning frame 116 comprises a plurality of vertical tubular posts 120 which are arranged in a symmetrical hexagonal pattern, and these are connected by truss members 122 which are shown somewhat schematically. The tubes 54 are located within the positioning frame 120 in the configuration shown in FIG. 8B. For ease of illustration the precise positioning devices for the tubes 54 are not shown, but these could be provided with a positioning plate having openings for the tubes 54, described previously herein. Alternatively, individual spacers could be used to position the tubes 54 or other arrangements.

Figure 9C:
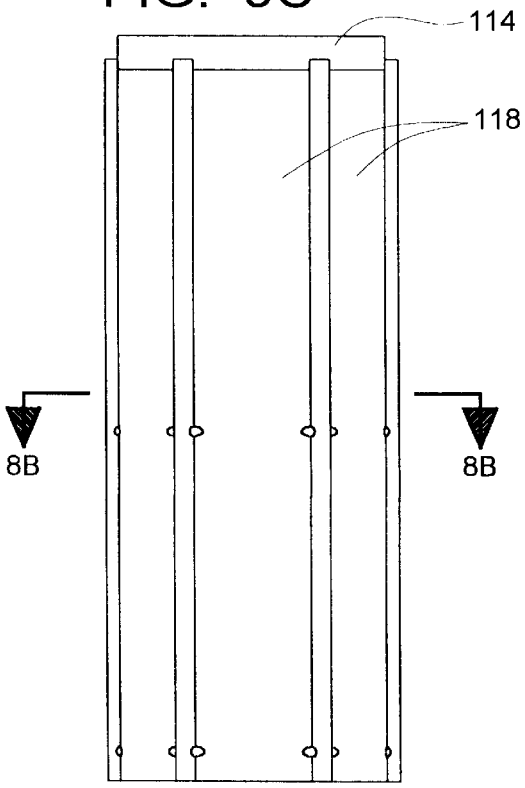
FIG. 9C is a side elevational view of the module of FIGS. 9A and 9B, but showing the module with the surrounding shroud.

FIG. 9C shows the entire module 110 in a side elevational view, with the shroud 118 enclosing the major part of the positioning frame 116, but with the vertical posts 120 positioned in the perimeter of the shroud 118. In this particular configuration, the shroud 118 can be made in six cylindrically curved segments which are attached between related posts 120, with the six sections collectively forming the cylindrical shroud 118.

Figure 9D:
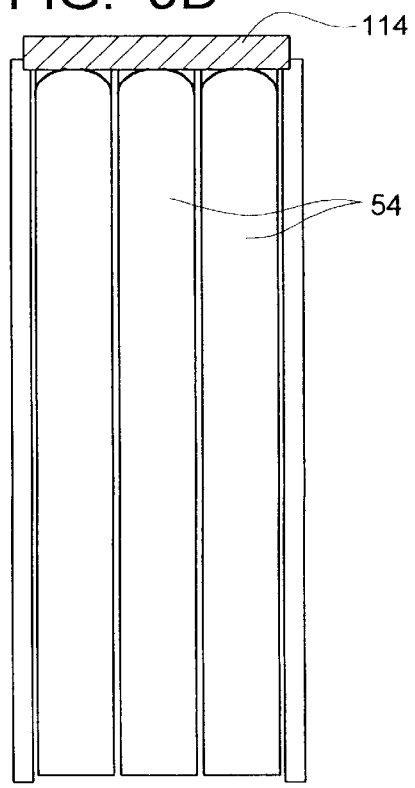
FIG. 9D is also a side elevational view of module of FIGS. 9A–9C, showing the flotation tubes positioned therein, but not showing the frame nor the shroud.

FIG. 9D is a sectional view taken along line 9D—9D of FIG. 8C.

The function of this module 112 is substantially the same as described previously herein, in that the flotation tubes 54 are positioned to provide a buoyancy force for the hull structure 40 which is positioned above. Within the broader scope of the present invention the module 112 would be suitable as stand-alone flotation module to provide buoyancy for mooring lines or TLP tendons.

This modular form of positioning the flotation tubes 54 can be of value in various ways. For example, in the initial installation of the flotation assembly, it may be more effective to pre-construct the modules 112 and then install the modules at the site at which the flotation assembly is to be established. Also, if it is necessary to make a replacement of one or more tubes, this could quite possibly be accomplished more effectively by simply removing an entire module and substituting this with another module, as opposed to attempting to replace one or two of a set of tubes 54 which are at less accessible locations beneath the hull structure 40.

Figure 10:
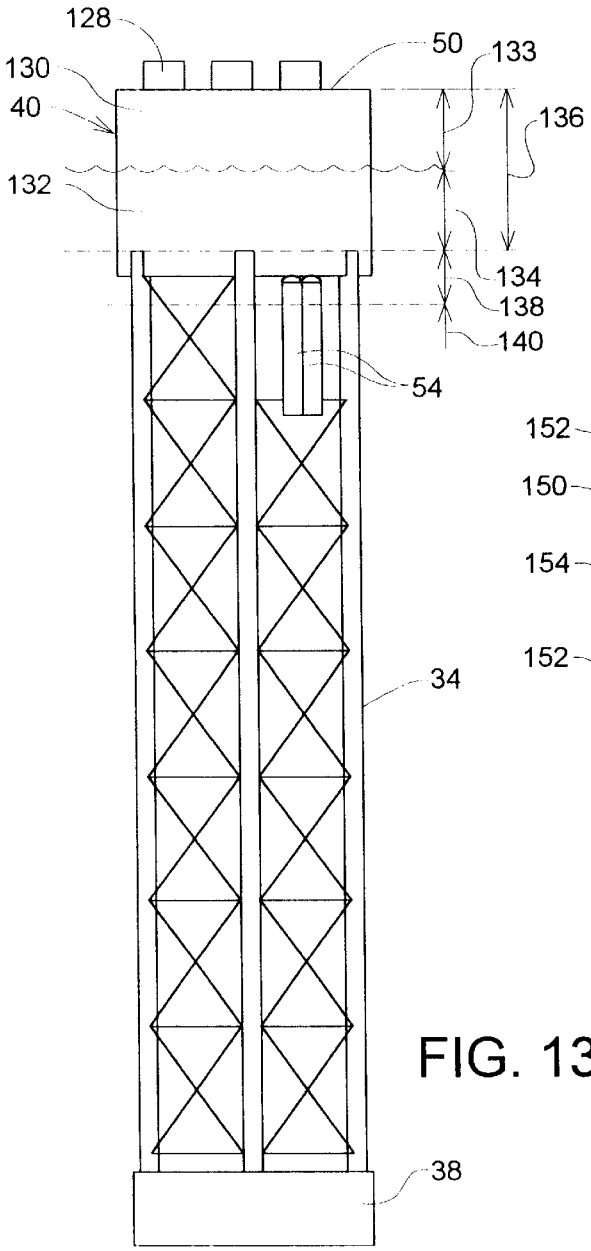
FIG. 10 is a side elevational view of the SPAR of the present invention positioned in the body of water in its operating position.

To describe now the steps in constructing and deploying the flotation assembly of the present invention, let us first assume that the flotation assembly is in the form of the SPAR assembly as shown in FIG. 10. It is presently contemplated that the preferred procedure in assembling and installing the flotation assembly is to construct it at a convenient location, with the SPAR assembly 30 complete and the flotation tubes 54 already installed therein. Then the entire SPAR assembly would be moved in to the water to assume a horizontal floating position. The flotation hull 40 would provide more than adequate buoyancy force for that portion of the structure and the ballast section 38 would be emptied to provide a flotation force at the opposite end. Additional flotation devices could be employed if needed.

If the tubes 54 are of the open bottom configuration, these would not provide flotation during deployment while in the horizontal position. At the location where the entire SPAR structure 30 is to be placed in its operating position, the ballast section 38 is flooded so that this sinks in the water to position the SPAR structure 30 in a vertical position. The mooring lines are attached and then deployed.

When the SPAR structure with the flotation tubes already positioned therein are vertically oriented, then the tubes 54 are themselves pressurized which provide the additional buoyany for full operation. Normally, the buoyancy provided by the flotation tubes 54 is not necessary when the SPAR structure 30 is being towed to the operating location, because the top side pay load weight is not at that time on the hull structure 40. The SPAR itself (with the hull structure 40 and the ballast section 38) would likely be enough to float the unloaded SPAR structure 30 in its horizontal position. If not, as indicated above, additional flotation devices could be provided. However before the top side weight is added to the hull structure 40, the flotation tubes 54 need to be pressurized to provide the additional flotation.

Reference is now made to FIG. 10 which shows the SPAR assembly 30 of the present invention in its installed location. For ease of illustration, only two of the flotation tubes 54 have been illustrated, it being understood that the entire array of flotation tubes 54 would be present. Also, the shroud or shell 58 has been omitted. The surface of the water is shown where there is very little wave action. It will be assumed that the upper surface of the hull structure 40 has been loaded with equipment, supplies, etc., these being shown somewhat schematically simply as three boxes 128.

An upper portion 130 of the hull structure 40 rises above the level of the sea water, and a lower portion 132 of the hull structure is positioned below the sea water surface. For example, in a typical installation of the present invention as an off-shore platform, the top surface 50 of the hull structure 40 could be approximately 40 to 60 feet above the sea surface for an average size flotation assembly, this height dimension being indicated by the arrow 133.

The lower part 132 of the hull structure 40 would extend downwardly to about 50 to 100 below the water surface in an average size platform assembly, as indicated at 134.

As indicated previously, there is what can be considered to be a wave impact zone which extends from a level above the water surface downwardly to a depth where the forces imposed by the wave action, wind, and other exterior occurrences would reasonably require that the displacement hull 40 have the rugged structure to properly withstand all of these forces, yet be properly sized for effective operation. This impact zone is indicated by the arrow 136. In general, this impact zone generally can be considered to be a depth as low as 30 feet below the water line and as high as 40–60 feet above the water line. Obviously, as indicated previously, these ranges could vary greatly, being larger or smaller, depending upon the location of the platform and various other factors.

Then there is what may be called a transition zone 138 where the movement of the water and forces of the water exist to some extent but are not considered to be appreciable, this we consider the intermediate or transition zone 138. Then beneath the intermediate zone would be the quiescent zone 140 where the forces exerted by the action in the water or from other sources is considered to be less significant.

As indicated previously, the SPAR assembly 30 can extend downwardly from the water surface by as much as 700 to 900 feet, with the main truss section 34 fixedly attached to the hull structure 40 and extending downwardly to the ballast section 38. The entire truss section and the ballast section 38 act in the manner of a pendulum to maintain the hull in a horizontal or nearly horizontal position. Also as indicated previously, anchor lines can be used to properly locate the assembly 30, and there would normally be a drill string or other equipment which extends downwardly through the central opening 49 of the hull structure 40 and also through the central opening 59 of the flotation section 42.

As indicated earlier, the hull structure 40 is commonly made of steel and has sufficient structural strength so that it can withstand the forces that would be created in severe storm conditions. These forces are considered to be greatest in what has been termed the wave impact zone, and this wave impact zone would extend from a location above the water surface and also below. Accordingly, one of the main design considerations in optimizing the present invention is to determine the reasonably predictable location and height dimension of this impact zone and select the dimensions of the flotation hull 40 accordingly.

The auxiliary flotation section 42 (see FIG. 5) should be positioned at a sufficient depth so that the flotation tubes 54 are substantially isolated from the forces that are created during severe operating conditions (e.g. in very stormy conditions). The outer shroud or jacket 58 (see FIGS. 4 and 5) is provided to provide protection from less severe loads, such as lesser wave or current action or impact loads that might occur from equipment impacting the flotation section. Also, as indicated previously, there is also provided the inner shroud 72 which protects the flotation tubes 54.

Thus, the outer shroud 58 and the inner shroud 72 are provided to prevent damage to the tubes 54 or possibly the associated positioning framework from loads such as impact loads from equipment that could be dropped or misplaced from crashing into the tubes or other such occurrences. However these are not arranged to resist the more massive loads which could be imparted by very stormy weather conditions.

The closed chamber 141 formed by the outer shell 58, inner shell 72 and hull structure 40 is occupied, in part, by tubes 54. The remaining space between the tubes can also be pressurized, lowering the water level 141*a* in the chamber 141 to provide additional buoyancy. Alternately, the spaces between tubes 54 and enclosed in chamber 141 can be filed with lightweight concrete or other suitable filler to provide buoyancy and additional structural integrity.

Let us now direct our attention to the buoyancy function that the tubes 54 provide. At this point, it would be helpful to look again at the analysis of the functioning of the tube 54 with reference to FIG. 6. It will be recalled that the side wall 78 of the tube 54 would normally experience only loads in hoop tension. A simplified explanation of the main function of the long cylindrical side wall is as follows. First, it should occupy a sufficient volume so that the water displaced by that volume is sufficiently large to create a high buoyancy force relative to its "foot print" (i.e. the space occupied in a horizontal plane to contribute substantially to the flotation of the hull structure. Second, it should do this in a manner so that it has sufficient structural strength to withstand the pressure of the water bearing against the side wall 78 which would tend to collapse the side wall 78 because of the water pressure. With the arrangement as shown in FIG. 6, the only load which the side wall 54 needs to withstand is those loads created in hoop tension due to the interior chamber 84 being pressurized to the extent necessary to withstand the compressive force of the surrounding water.

Now we look to the cap 80. This cap 80 is actually what could be considered the load bearing member. The upper surface 82 of the cap 80 has water pressure bearing downwardly on it at a depth of 50 feet. This would be approximately 25 pounds per square inch, and if we assume that the tube side wall 78 has a 12-foot diameter, the cross-sectional area would be about 16,277 square inches, with the downward force of the water being 25 pounds per square inch, there would be about 407,000 pounds of force pressing downwardly on the top cap 80. However, the air pressure in the chamber 84 is three times the level of the water pressure pressing down on the cap 82, creating a net upward force of in the neighborhood of 800,00 pounds.

Figure 11:
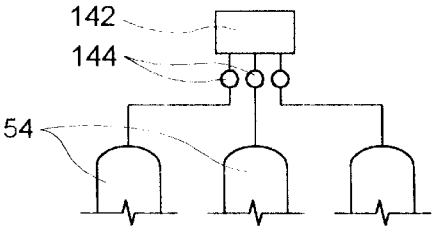
FIG. 11 is a schematic view of the pressurizing system of the invention.

Another advantage of the present invention is that the buoyancy of the auxiliary flotation section 42 can easily be controlled by the inflating and deflation system which is shown somewhat schematically in FIG. 11. There is a source of compressed gas, (i.e. air, an inert gas or other gaseous substance) 142 which connects to a plurality of valves 144, with each of the valves 144 being connected to a related flotation tube 54. To create more buoyancy, one or more of the valves 144 could be opened to move more compressed gas into the selected flotation tubes 54 to lower the water level in those tubes and thus increase the buoyancy. Alternatively, one or more of the valves 144 can be vented to let gas out of one or more of the flotation tubes 54 to decrease the buoyancy. Further, the pattern of flotation can be controlled by selecting the tube or tubes 54 which are to be filled with more compressed gas or to be vented. Thus, if the hull structure 40 is being loaded unequally at one location as opposed to another, and it is desired to shift the location of the buoyancy forces accordingly, this could be quite easily done with the present invention.

Thus, the outer shroud 20 and the inner shroud 72 are provided to prevent damage to the tubes 54 or possibly the associated positioning framework from loads such as moderate wave and current loads or impact loads from equipment that could be dropped or misplaced from crashing into the tubes or other such occurrences. However these are not arranged to resist the more massive loads which could be imparted by very stormy weather conditions.

Figure 12:
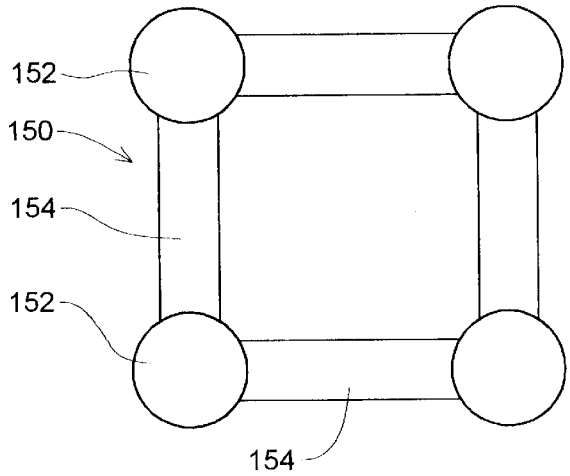
FIG. 12 is a top plan view of a second embodiment of the resent invention incorporated in a tension leg platform.

Reference is now made to FIG. 12 where there is shown in plan view a tension leg platform 150. This tension leg platform 150 comprises four vertically aligned cylindrical legs 152 which are spaced from on another in a square pattern. Interconnecting the four legs 152 are four horizontally extending structures 154, each having a rectangular cross-sectional configuration, and with these structures 154 formed in a square configuration with the legs 152 being at the corners of the square.

The four vertical legs, could be, for example, from 40 to 90 feet in diameter, and the horizontal elongate structures 154 could each be,for example, 200 feet in length. The actual support platform (not shown herein for ease of illustration) is positioned at the upper end portions of the legs 152.

Below each of the legs 152, there is provided a related flotation assembly 156 which is, or may be, the same or similar to the flotation assemblies which are described earlier in this text and shown in the accompanied drawings.

The flotation assemblies may be retrofit for existing platforms, or incorporated into the original design of the platforms.

Figure 14:
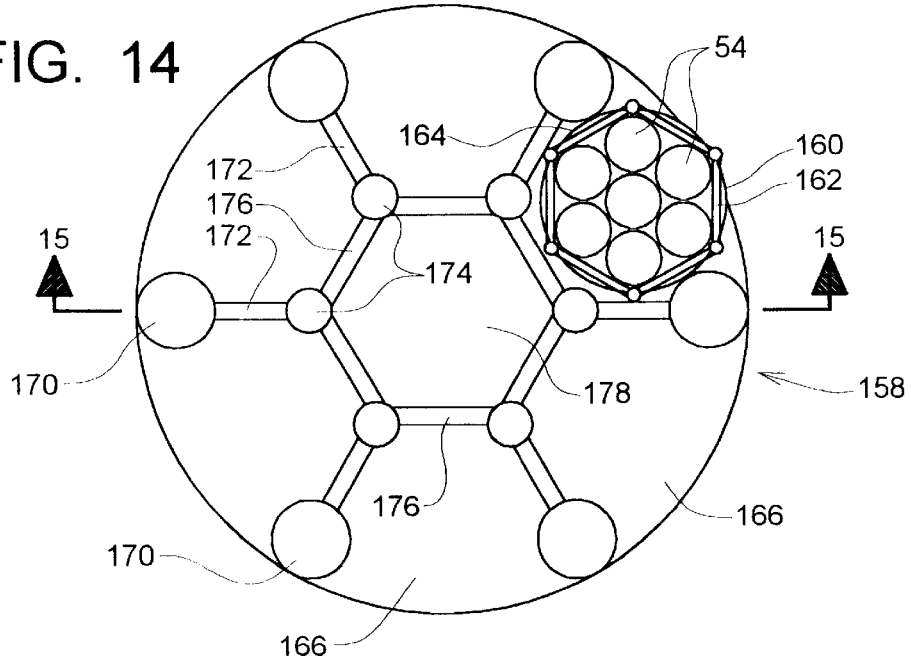
FIG. 14 is a top plan view of another form of the auxiliary flotation assembly of the present invention.
Figure 15:
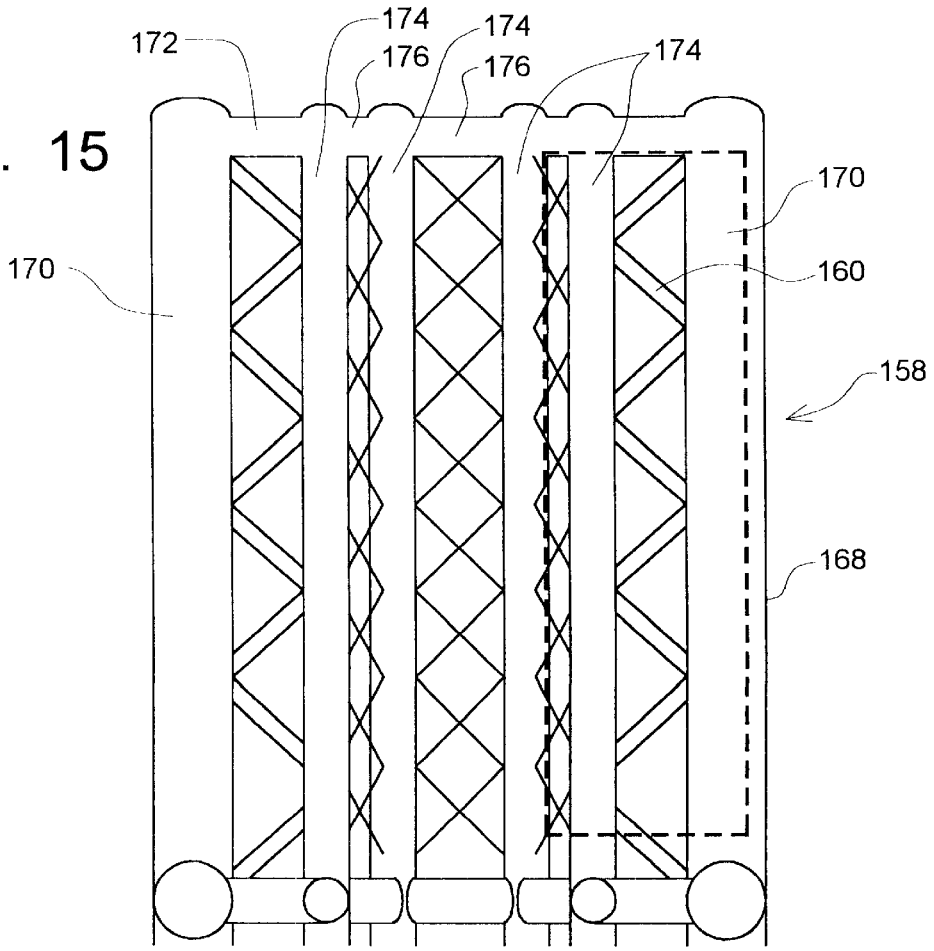
FIG. 15 is a side elevational view of the auxiliary flotation assembly in FIG. 14.
Figure 16:
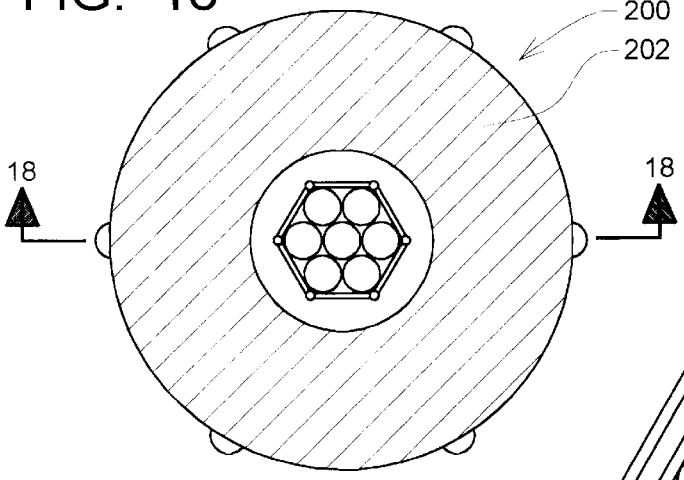
FIG. 16 is a cross-sectional view taken along lines 16—16 of FIG. 18 showing a third embodiment of the present invention, incorporated to provide buoyancy to risers associated with a SPAR.

Another embodiment 158 of a flotation assembly is shown in plan view of FIG. 14, and FIG. 15 is a side sectional view taken along line 15—15 of FIG. 14.

The flotation tubes 54 are arranged in six groups of seven flotation tubes each, each group being generally designated 160. In each group 160, there are 6 tubes 54 arranged in a hexagonal pattern and a center tube 54. Each group 160 of seven flotation tubes 54 has upper and lower perimeter frames 162 which are (or may be) the same or similar to those described elsewhere in this text, and there is also for each group 160 a surrounding cylindrical shroud 164.

In FIG. 14, there is only shown one of the groups 160 of tubes, and it is to be understood that similar groups 160 of tubes 54 are positioned in the other five areas. For identification, the six areas where the groups 160 are situated are designated generally as 166.

To position the tube groups 160 there is a larger assembly frame 168. This assembly frame 168 comprises six vertical hollow columns 170, arranged in a hexagonal pattern. Extending radially inwardly from each column 170 are upper and lower horizontal struts 172, with each upper and lower pair of struts 172 connecting to a related interior vertical column 174, these also being arranged in a hexagonal pattern matching that of the outer vertical columns 170. The six interior vertical columns 174 are each interconnected by upper and lower struts 176 arranged in a hexagonal pattern.

It can be seen that each of the receiving areas 166 is defined by an adjacent pair of the outer columns 170, and adjacent pair of two interior columns 174, and their related interconnecting struts 172 and 176.

The flotation assembly 158 of FIG. 14 is formed with an open center area 178. One of the advantages of the arrangement of FIG. 14 and FIG. 15 is that with each group 160 of seven tubes 54 being held in position by the frame 162 and surrounded by the shroud 164, it can function essentially as a unit which can be inserted into its area 16 in the larger assembly frame 168. Thus, if replacement or repair is required for one or more of the tubes 54 of any one group 160, the entire group unit 160 can be removed and replaced by another group 160 while the repairs and replacements are being made.

It is believed that the operation of this embodiment of FIGS. 14 and 15 is readily understandable from reviewing other portions of this text, so this will not be repeated in this section of this text.

Third Embodiment of the Present Invention

The third embodiment of the present invention is designated generally as 200 and is shown in FIGS. 16 through 19. This flotation assembly 200 is in the form of a SPAR and comprises a hull 202, a SPAR frame 204 and a flotation apparatus 206 which in this embodiment can be considered to be a flotation module. The hull 202 and the SPAR frame 204 are fixedly connected to one another and act as a unit while the flotation module 206 is positioned within the hull 202 and the frame 204, and is able to move vertically independently of the hull 202 the SPAR frame 204.

In this particular embodiment, the hull 202 can be a conventional hull (or a nearly conventional hull) where the volume of the hull is sufficiently great so that it is able to float both the hull 202 and the SPAR frame 204. Also, as an alternative, the hull 202 could be replaced with a flotation assembly such as that shown as 32 in FIGS. 2 and 5.

To describe now the flotation apparatus 206, there is first a central section 208 which extends from a lower location upwardly and thence through the center opening 210 of the hull 202. Then there is a surrounding section 212 which surrounds the lower part of the central section 208.

The central section 208 comprises three groups of flotation tubes 214 (with seven tubes 214 in each group), with these three groups being the following, a lower group 216, an intermediate group 218 and an uppermost group 220. The tubes 214 of the uppermost group 220 bear against the lower surface 222 of a central load carrying support structure 224. This load carrying structure 224 functions as a flotation support region against which the flotation lift forces of the upper group 220 of the tubes 214 bear directly.

The upper load carrying support structure 224 can be utilized in either or both of two ways. First, the upper surface 228 of the support structure 224 could support objects placed thereon. Second, in functioning as a support for the risers, at least some of the tubes 214 have a central tubular member which is arranged in a manner similar to the open ended tube 96*c* in the flotation tube 54C shown in FIG. 6*c*. The risers thus can extend upwardly through vertically aligned sets of three tubes 214. In the following description of the various arrangements of the lower, intermediate, and upper tube groups 216, 218, 220, respectively, it is to be understood that in each instance, each vertically aligned set of tubes that are used to have the riser extending therethrough will have the tube configuration of the tube 54C of FIG. 6*c*.

In the particular arrangement shown herein, the lower flotation tubes 214 of the lowermost group 216 are substantially the same as shown in FIG. 6*a*, where there is the upper cap 80*a* and the lower open end at 86*a*. Assuming that the level of the water in the lowermost tubes 214 is near the bottom end of these tubes, the air pressure in the tube chambers 84*a* is slightly below the water pressure at the level of the water at the lowermost ends in the lowermost tubes 214.

The tubes 214 located in the intermediate group 218 can function in either of two modes. First, the upper and lower ends 80 and 90 of each of the intermediate tubes 214 of the group 218 can be closed, and the air pressure in the chamber of the intermediate tubes 214 can be raised to a level equal to (or even slightly greater than) the pressure in the lowermost tubes 214 the group 222. In like manner, the tubes 214 and the uppermost group 220 also can be closed at both the top and bottom ends and also pressurized to the same pressure level (or even greater than the pressure level in the intermediate lower tubes 214 in the intermediate lower groups 220 and 222, respectively). In that arrangement, the side walls 78 of each of the tubes in the three groups are all, of course, placed in hoop tension, but in addition have axially aligned tension loads placed thereon.

Alternatively, the tubes 214 of the intermediate and upper sets 218 and 220 can be made so as to have openings at their lower ends, as indicated at 98*e* in FIG. 6*e*. In that situation, the side wall 78 of each of the tubes 214 in the upper and lower groups 220 and 218 would be made of a material with a high strength to weight ratio for resisting the axial compressive loads, such as steel or some other material.

The three tube groups 216–220 are enclosed in a surrounding structural cylinder 232 which is constructed to resist axially aligned loads. This structural shell 232 is fixedly connected to the upper support structure 224. This shell structure 232 is also fixedly connected to the annular section 212 as will be described immediately below.

Figure 17:
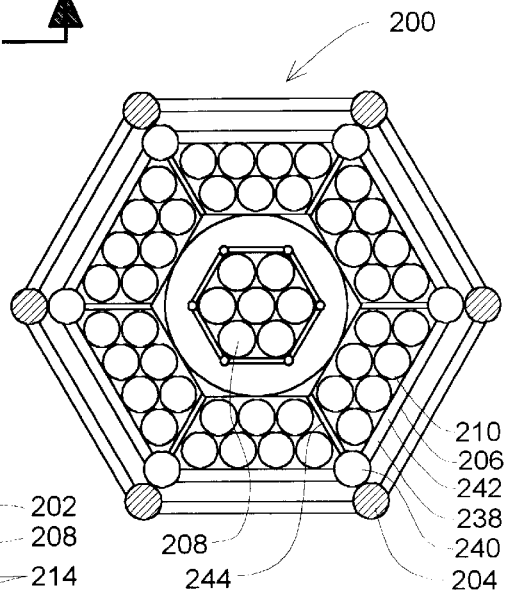
FIG. 17 is a sectional view taken along line 17—17 of FIG. 18, also showing the third embodiment.
Figure 18:
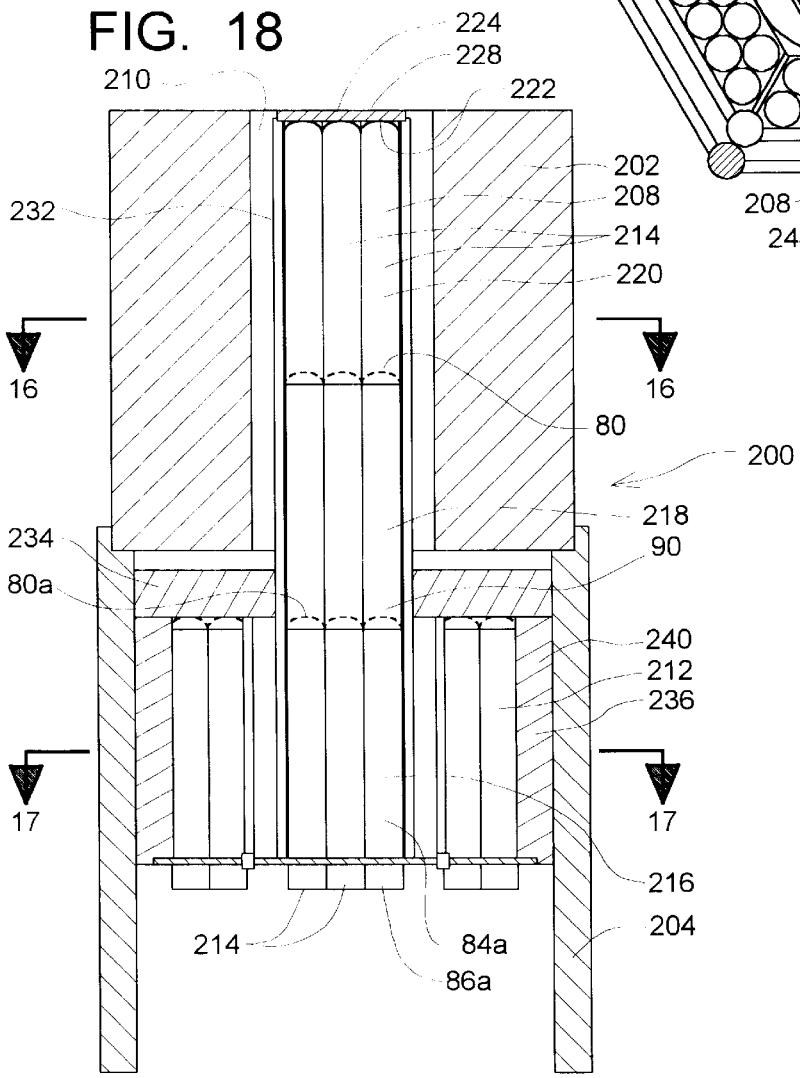
FIG. 18 is a longitudinal sectional view taken along line 18—18, also of the third embodiment.
Figure 19:
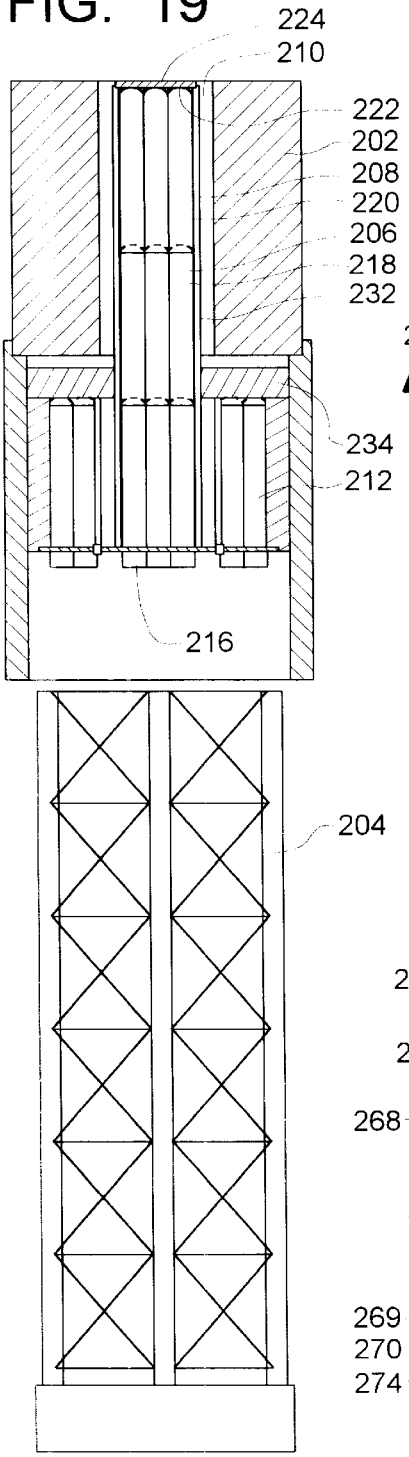
FIG. 19 is a longitudinal sectional view similar to FIG. 18, but showing the third embodiment of the present invention as part of the entire SPAR structure.

The surrounding section 212 of the flotation assembly 206 comprises an annular horizontally aligned support structure 234 and a structural frame 236 which is connected to the perimeter portion of the support structure 234 and extends downwardly therefrom. More particularly, this support frame 236 comprises a plurality of vertical support tubes 240 interconnected by struts 242 (see FIG. 17). Contained within the structure frame 236, there are six groups 243 of flotation tubes 214. There are radially inwardly extending struts 244, and these in turn connect to inner struts 246 which have a hexagonal pattern similar to that of the outer struts 242. Overall, this arrangement shown in FIG. 17 is rather similar to that shown in FIG. 4, except that in FIG. 17 there are fewer flotation tubes. The SPAR frame 204 is (or may be) the same as the truss section 34 shown in FIG. 2.

In operation of flotation assembly 200 being positioned in a body of water, the flotation tubes 240 in the surrounding flotation section 212 bear against the annular support structure 234 to push it upwardly. The support structure 234 in turn transmits a vertical lifting force into the shell 232 that in turn bears against the upper load carrying structure 224.

In addition, the tubes 214 of the three vertical tube groups 216, 218 and 220 bear against the upper load carrying structure 224. As indicated previously, the flotation module 206 is constrained within the hull 202 and the SPAR frame 204 to limit any lateral movement, but this flotation module 206 is able to move vertically independently of the hull 202 and SPAR frame 204.

Fourth Embodiment

Figure 20:
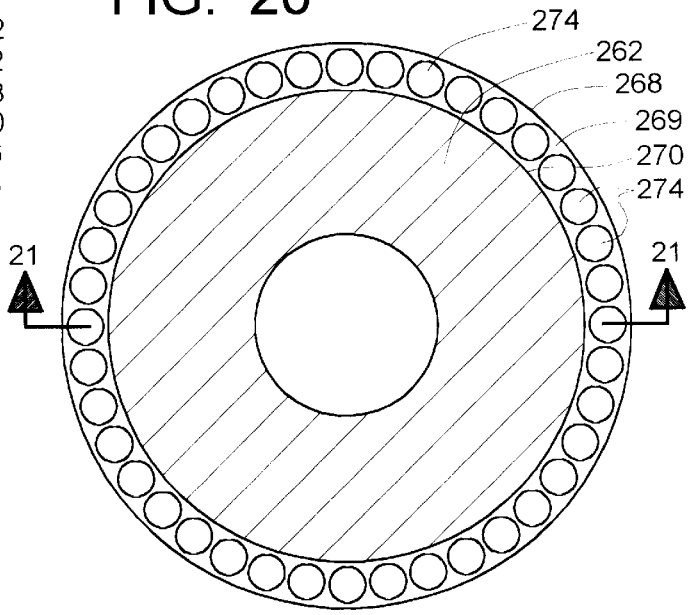
FIG. 20 is a cross-sectional view taken along line 20—20, showing a fourth embodiment of the present invention.
Figure 21:
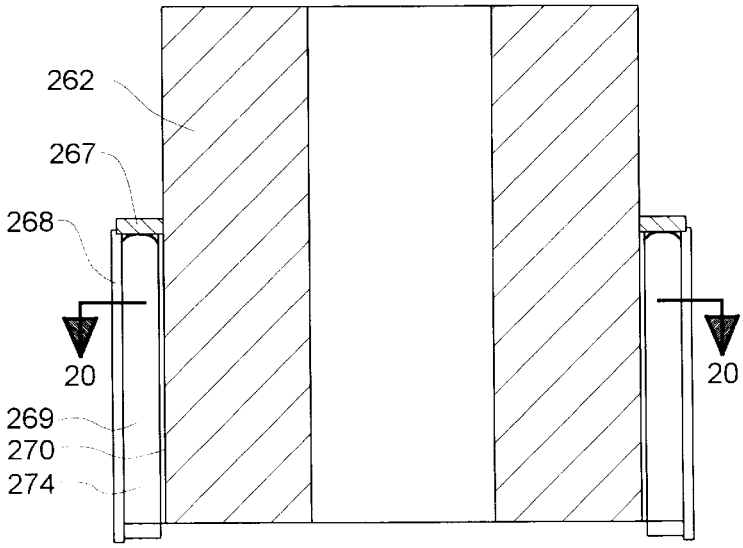
FIG. 21 is a longitudinal section view taken along line 21—21 of FIG. 20, also showing the fourth embodiment.

This fourth embodiment will now be described with references to FIGS. 20, 21 and 22. The situation for which this fourth embodiment is particularly adapted is where there is an existing prior art SPAR and the flotation capacity of the existing SPAR is not adequate to meet increased performance demands, in that the additional weight created by equipment, risers, etc. exceed the present flotation capacity of the SPAR.

Figure 22:
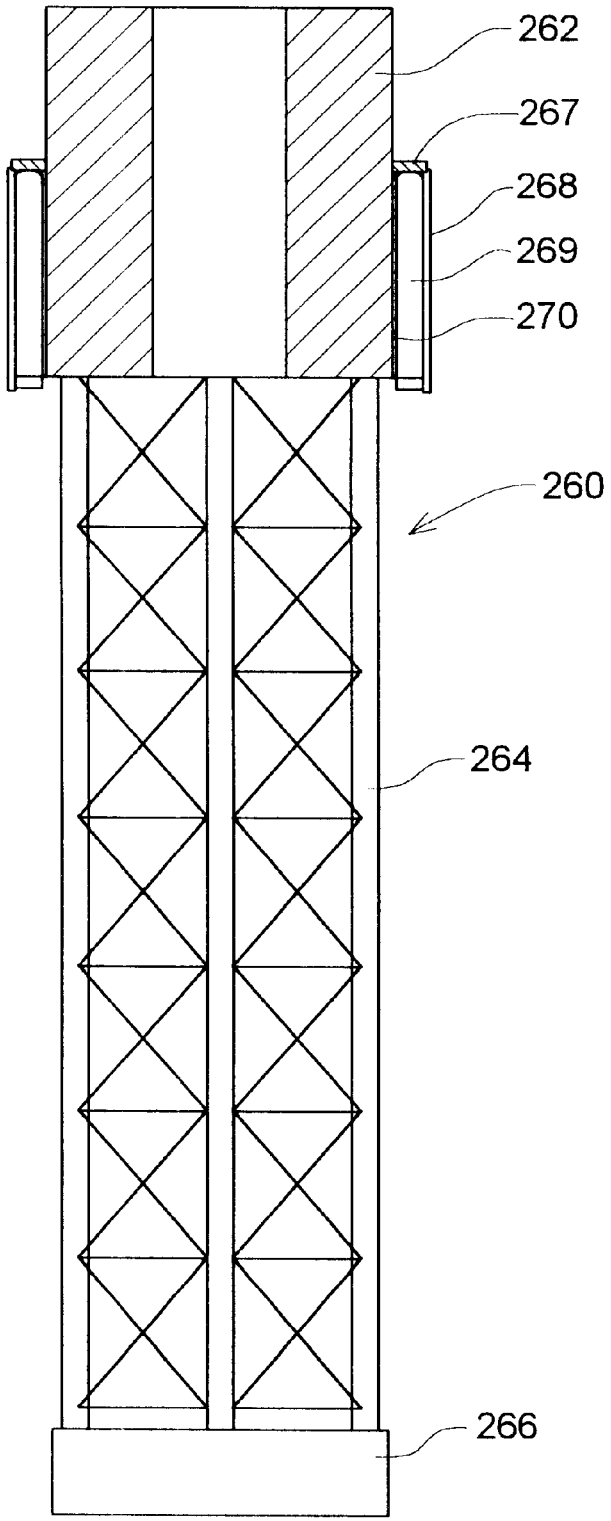
FIG. 22 is a longitudinal sectional view such as FIG. 21, but showing the entire SPAR assembly of the fourth embodiment.

As shown in FIG. 22, the SPAR 260 comprises the hull 262 and the SPAR truss 264 and the ballast section 266. To provide the additional support, there is added to the hull 262 at an intermediate location a surrounding annular, horizontally aligned flange 267. Attached to the outer edge of the flange 267 and extending downwardly therefrom is a surrounding cylindrical shroud 268 which provides an annular flotation space 269 between the shroud 268 and the radially inward cylindrical outer surface portion 270 of the hull 262.

Positioned in this flotation space 269 is a plurality of flotation tubes 274. These flotation tubes 274 can be brought to the location of the SPAR 260 and then lowered to a position a short distance below the shroud 268. Each of the flotation tubes 274 is at that time filled with water. Then a small amount of air is injected into the upper end of the tube 274 and the tube is caused to rise into the annular space 269 enclosed by the shroud 268. As the additional flotation tubes 274 are brought into their position within the shroud 268, these can be positioned by suitable means so that these remain in proper vertical alignment. When the tubes 274 are all in place, then additional pressurized air can be directed into the tubes 274 to lower the water level in the tubes 274 and thus cause the tubes 274 to apply a flotation force against the flange 266 in the manner described above.

Fifth Embodiment

The fifth embodiment is shown in FIGS. 23 through 27. This fifth embodiment is similar to the first embodiment as shown in FIGS. 2 and 5, except that the conventional hull of the first embodiment has been replaced with a support structure which is positioned at or above the water surface.

In this fifth embodiment, there is a SPAR 290 comprising an upper flotation section 292, a SPAR truss 294, and a lower ballast section 296. The flotation assembly 292 comprises an upper annular support structure 298, an upper group 300 of flotation tubes 302, a lower group 304 of flotation tubes 306, and upper and lower shroud sections 308 and 310, respectively. The support structure 298 and the upper and lower flotation tube groups 300 and 304 define a central through opening 305.

Figure 23:
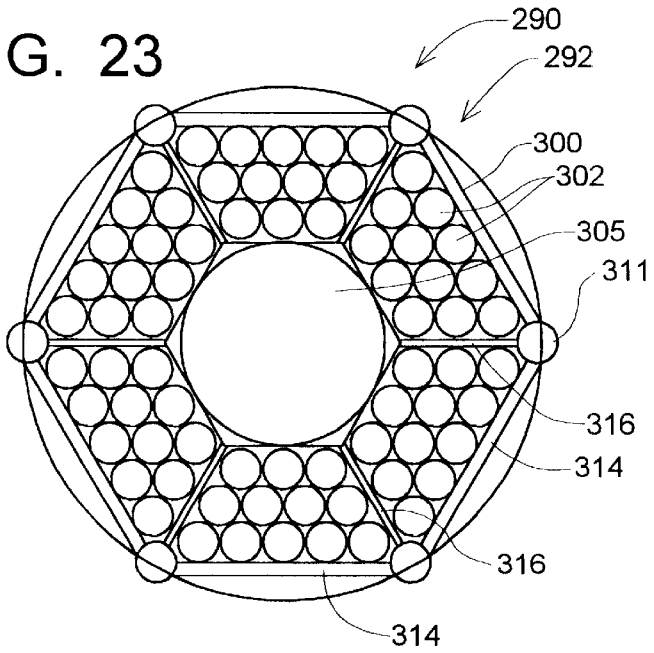
FIG. 23 is a cross-sectional view taken along line 23—23 of FIG. 24, showing a fifth embodiment of the present invention.
Figure 24:
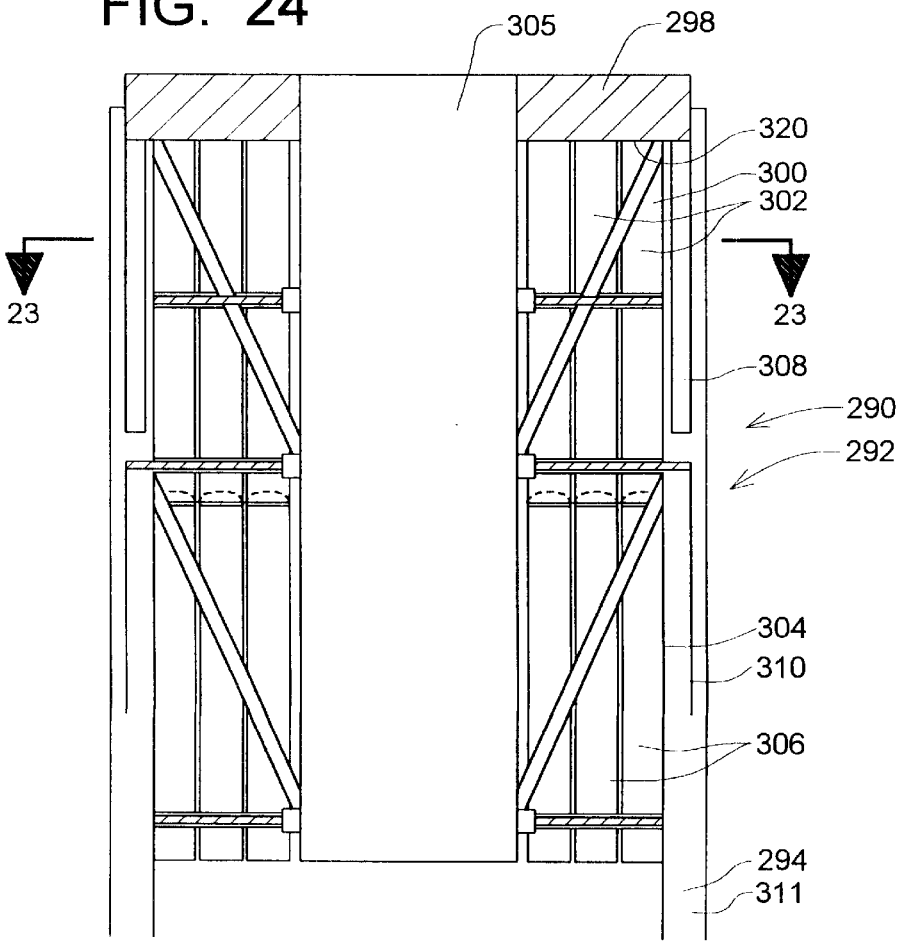
FIG. 24 is a longitudinal sectional view of the fifth embodiment.

As can be seen in FIG. 23, the arrangement of the upper group 300 flotation tubes 302 is substantially in the same arrangement as shown in FIG. 4 of the first embodiment. Thus, there are vertical columns 311 in a hexagonal configuration, upper and lower positioning frames 312 comprising perimeter struts 314, radially extending struts 316 and inner struts 318, with the flotation tubes 302 arranged in six groups in six trapezoidal frame sections.

The lower group 304 of flotation tubes 306 has exactly the same arrangement as shown in FIG. 23, and each of the flotation tubes 306 in the lower group 304 is positioned in vertical alignment with, and bears against, an aligned upper flotation tube 302 immediately above. Thus, it can be seen that the lower surface 320 of the support structure 298 forms the flotation support region of the support structure 298 where the upper ends of the upper tubes 302 bear against the lower surface 320. The support structure 298 is made as a platform with sufficient structural strength to support the various loads which are placed thereon (e.g. the weight of personnel, equipment, the flotation forces, as well as the loads imposed thereon by wave action and other influences).

Also, the upper shroud section 308 is made with sufficient structural strength to withstand the various forces to which it is subjected by wave action and other forces. The structural strength of the upper shroud section 308 can be provided in various ways. For example, a structural member can be placed around the periphery of the central opening 305, at the location of the upper group 300 of tubes 302 at the location of the upper group 300 of tubes 302 with radially aligned struts extending through the region occupied by the upper tubes 302 to form to a perimeter structure. Also, the perimeter structure itself could be made sufficiently strong to withstand such forces.

The lower shroud section 310 would normally be located below the impact zone and entirely (or at least in large part) located in the quiescent zone. Accordingly, the lower shroud section 310 could be made in much the same manner as the shroud 58 of the first embodiment.

Figure 27:
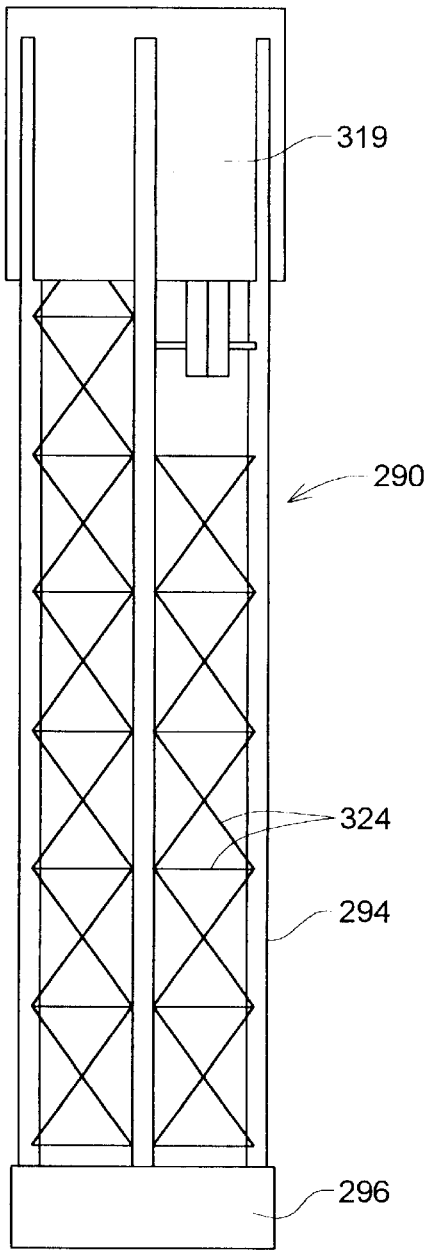
FIG. 27 is a elevational view similar to FIG. 26, but showing a modified version of the fifth embodiment.

The SPAR truss 294 comprises a plurality of vertical columns 311 which extend downwardly from the support structure and which are interconnected by various cross braces 324 that are both horizontally and diagonally aligned. These vertical tube member 322 extend all the way up to the upper support structure 298 to form with the upper support structure 298 a unitary rigid SPAR structure. In FIG. 27 the SPAR is shown with an outer shroud 319 extending downwardly over the upper portion of the lower flotation tubes 306.

Figure 25:
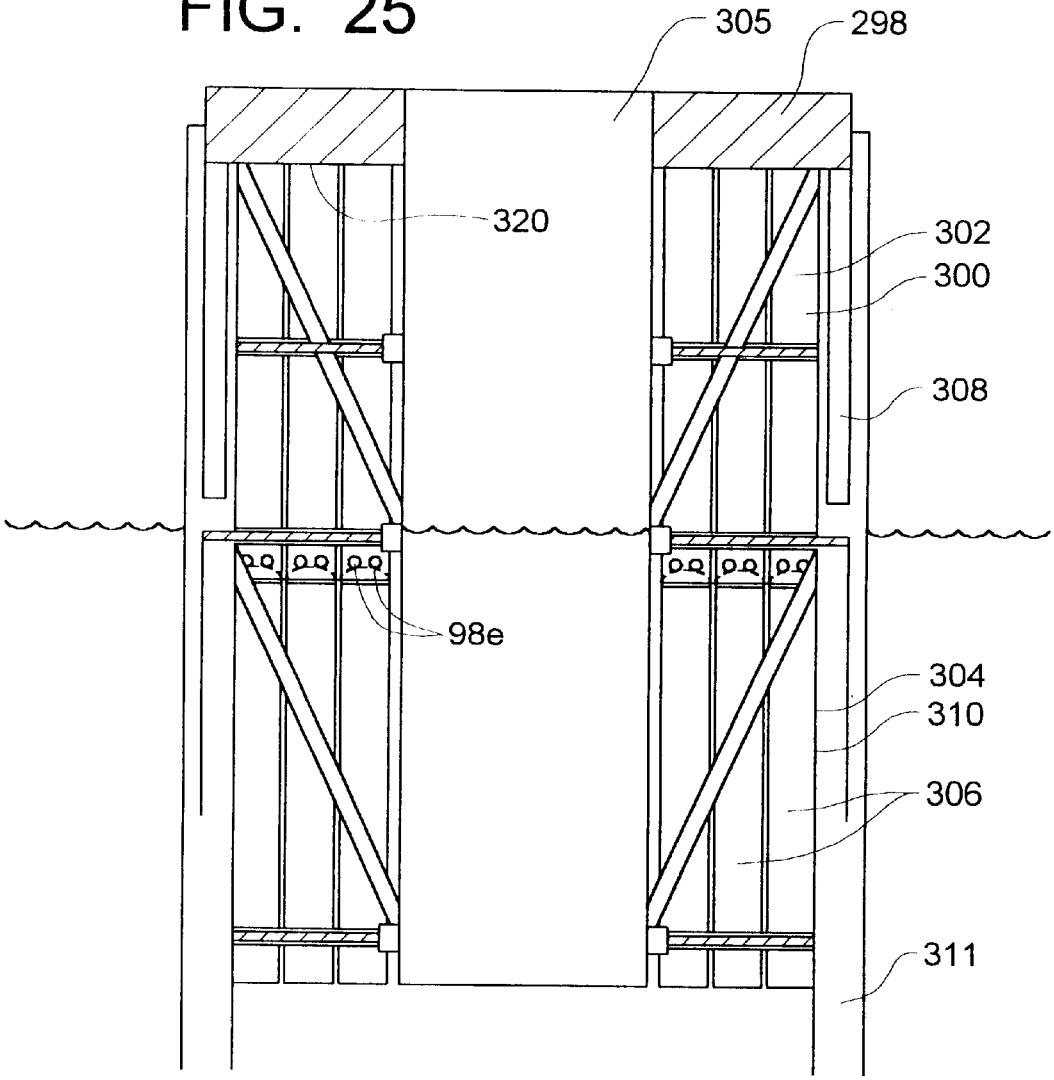
FIG. 25 is a longitudinal sectional view similar to FIG. 24, but drawn to a larger scale, showing the fifth embodiment.

In operation, with the SPAR 290 being positioned in a body of water, as indicated in FIG. 25, the level of the water is at about the mid height of the upper group 300 of the flotation tubes 302. It will be noted that at the lower end of these flotation tubes 302, there are vent openings **98*e*, as shown for the flotation tubes 54*e* in FIG. 6E. Therefore, in accordance with the explanation previously with the flotation tube arrangement of FIG. 6E, the upper flotation tubes 302 will function in a manner to provide a flotation force which would be proportional to the air volume of each of the flotation tubes 302 that is above the water level in the flotation tubes up to the level of the surrounding water. In addition, the side wall of each of the tubes 302 will need to be constructed to take compression loads from the support structure 298 and transmit these to the upper ends of the lower group 304 of flotation tubes 306. The flotation tubes 306 function in the manner of the flotation tubes 54*a* shown in FIG. 6A. Thus, the side wall of the lower flotation tubes 306** will experience no axial compression loads, but will experience forces in hoop tension.

Sixth Embodiment

Figure 28:
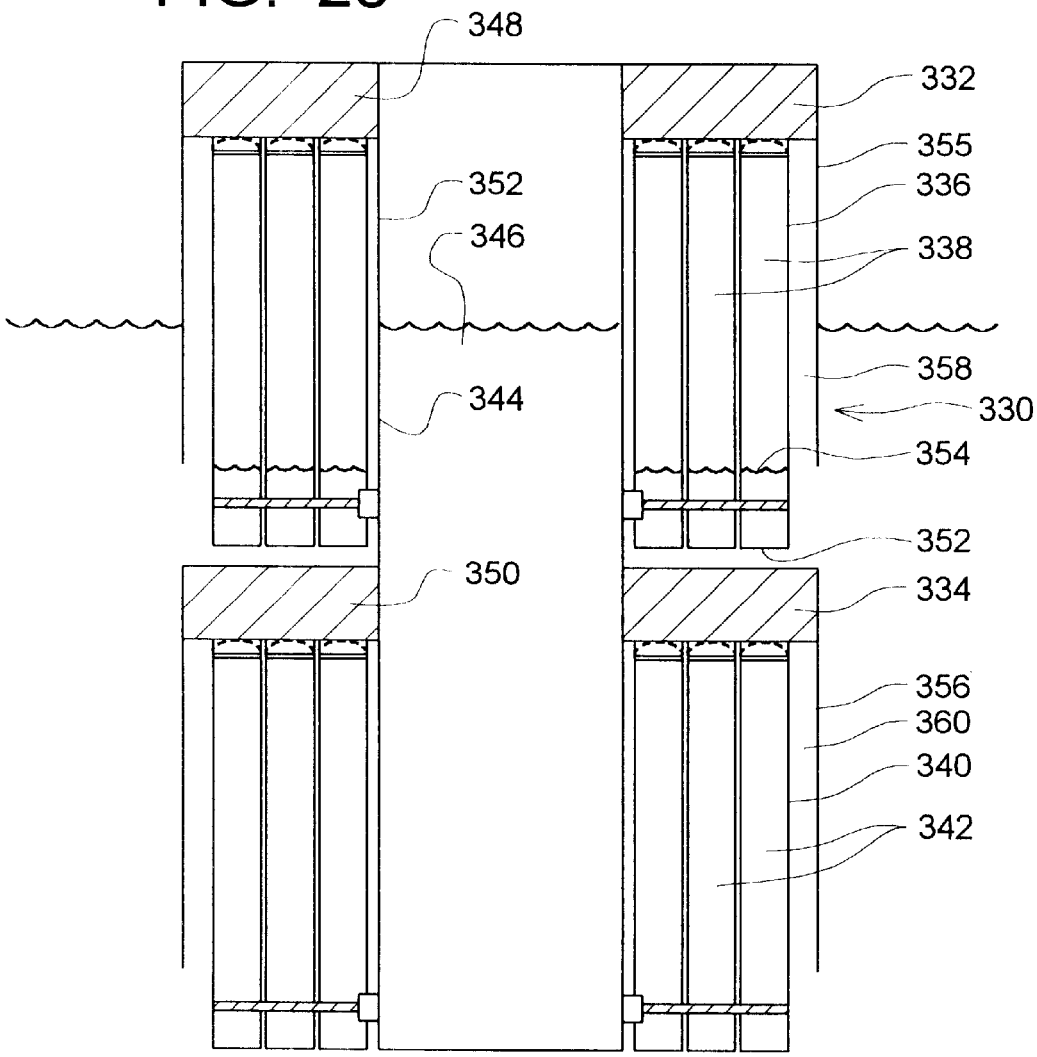
FIG. 28 is a longitudinal sectional view of a sixth embodiment.

A sixth embodiment of the present invention is shown in FIG. 28. This sixth embodiment has similarities to the fifth embodiment, and FIG. 28 is drawn somewhat schematically as is FIG. 24 which shows the fifth embodiment.

This sixth embodiment of FIG. 28 differs from the fifth embodiment primarily in that the lower set of flotation tubes does not have any direct bearing engagement with the upper set of flotation tubes. Rather, the buoyancy forces of the lower flotation tubes is transmitted into structure which in turn transmits these loads through structure to an upper support structure above the water level. Thus, while both the upper and lower flotation tubes provide a buoyancy force, in terms of transmitting these buoyancy forces into the structure, they operate separately from one another but combine in the sense that they do provide a net buoyancy force.

Figure 26:
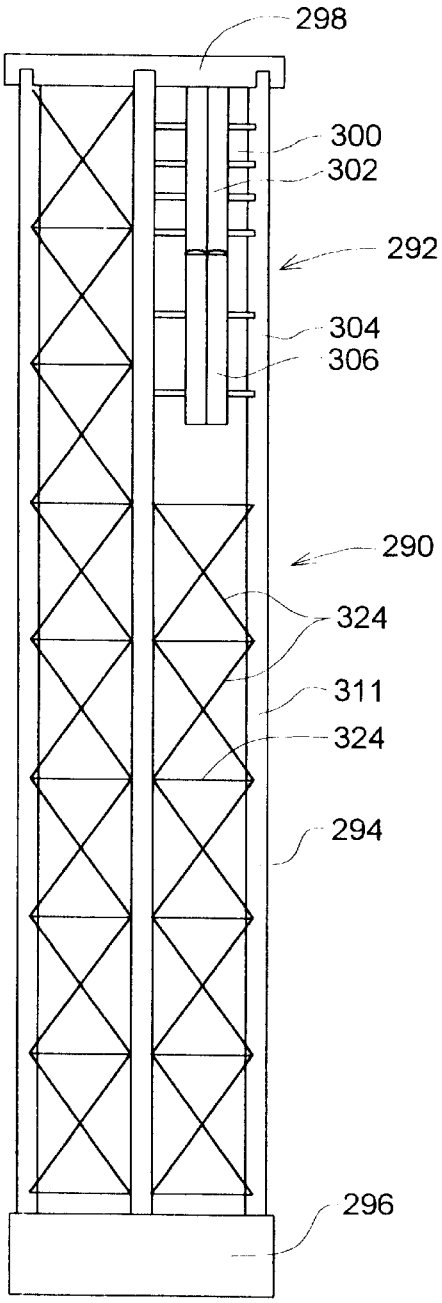
FIG. 26 is a front elevational view, with certain parts removed for purposes of illustration, showing the entire SPAR structure of the fifth embodiment.

Also, it is to be understood that the sixth embodiment as shown in FIG. 28 could be incorporated in a float assembly, such as a SPAR assembly, as shown in FIGS. 26 and 27.

The flotation assembly 330 of this sixth embodiment comprises an upper annular support structure 332 located above the water level, and a lower support structure 334 located below the water level. (the water level being indicated at 335).

There is an upper group 336 of upper flotation tubes 338 which bear against the lower surface of the upper support structure 332, and also a lower group 340 of lower flotation tubes 342 that bear against the bottom surface of the lower support structure 334.

There is an interconnecting structure 344 which defines a through central opening 346. The upper end portion 348 of this interconnecting structure 334 connects to the upper support structure 332, and an intermediate portion 350 of the interconnecting structure connects to the lower support structure 334. Thus, the buoyancy forces of the lower set of tubes 342 are reacted from the structure 334 into the interconnecting structure 350, and then transmitted upwardly through the upper portion 352 of the interconnecting structure 344 and thence into the upper support structure 332.

It will be noted that the lower end portions 352 of the upper flotation tubes 338 are open. Thus, with the upper flotation tubes 338 being pressurized so that the water level in the tubes 338 is only a short or moderate distance above the lower ends 342 of these flotation tubes 338, the air pressure in the flotation tubes 338 will be substantially equal (or exactly equal) to the water pressure in the open water at the water level 354 in each of the tubes 338.

Therefore, in the arrangement of FIG. 28, both the upper and lower sets of tubes 338 and 342 are not subjected to axial compression loads. Rather, both sets of tubes 338 and 342 are subjected only to hoop tension. The summation of the forces exerted by the pressurized air in the two sets 336 and 340 of tubes 338 and 342 is equal to the total weight of the flotation assembly 330.

Also, there is an upper shroud 355 surrounding the upper tubes 338 and a lower shroud 356 surrounding the lower tubes 342. As in one or more of the prior embodiments, the space 358 that is enclosed by the upper shroud 355 and the lower space 360 enclosed by the lower shroud 356 can also be filled with pressurized air (or other gas) to provide additional buoyancy.

It is to be understood that while the upper shroud 355 has been shown schematically by a single line, this upper shroud 355 can be made as a structural member that forms with the upper structure a unitary structure capable of withstanding impact loads of waves, etc. thus, the tubes 338 are protected from such impact loads and can be designed to withstand primarily the load which result from the tubes performing their flotation functions. This sixth embodiment can be incorporated in a truss structure as is done in the fifth embodiment of FIGS. 23–27.

Seventh Embodiment

Figure 29:
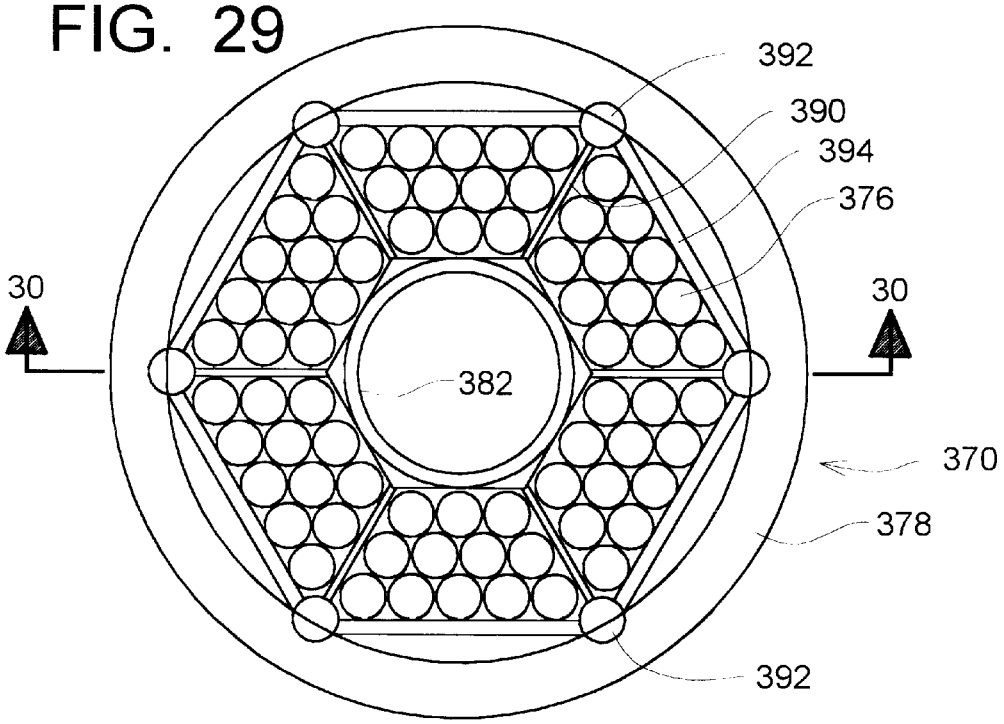
FIG. 29 is a horizontal cross-sectional taken along line 29—29 showing a seventh embodiment of the present invention.
Figure 30:
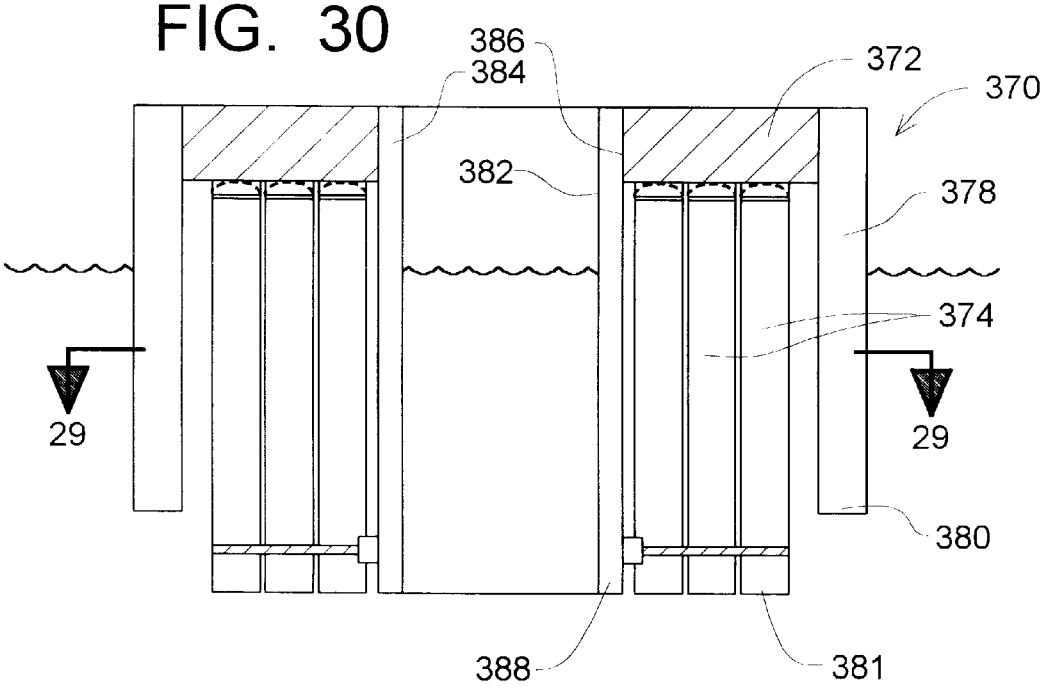
FIG. 30 is a longitudinal cross-sectional view of the seventh embodiment, taken along line 30—30 of FIG. 29.

The seventh embodiment of the present invention is shown is FIGS. 29 and 30. This embodiment is similar to the embodiment shown in FIG. 28, except that the lower support structure and lower flotation tubes of FIG. 28 have been deleted.

Thus, in this seventh embodiment, there is a flotation assembly 370 comprising an annular support structure 372 which can be similar to the support structure 332 of the sixth embodiment. Also, there is a plurality of flotation tubes 374 arranged in six groups 376. There is a cylindrical outer structure 378 which surrounds the flotation tubes 374, the upper circumferential edge portion of which surrounds it is fixedly attached to the upper annular structure 372. The two structures 372 and 378 form a unitary structure which has sufficient structural strength to withstand the various impacts of waves and other forces.

The lower edge portion 380 of the circumferential structure 378 extends downwardly around the tubes 374 to a sufficient depth to protect the tubes 374 from any substantial forces resulting from wave action. Also, the surrounding structure 378 has sufficient strength to protect the tubes 374 from other external forces such as impacts from various items, etc. The bottom ends of the flotation tubes are open.

Also, there is an inner cylindrical structure 382, the upper edge portion 384 of which is connected to the inside surface 386 of the structure 372. This cylindrical structure 382 extends downwardly, with the lower edge portion 388 thereof reaching to the lower ends 381 of the tubes 374.

In a preferred version, the inner cylindrical structural member 382 is structurally interconnected with the outer cylindrical structure 378 in a manner to enable both the structures 378 and 382 to cooperate with one another to create overall strength. More specifically, this is accomplished by providing a plurality of radially extending plates or frame members 390 that extend radially from the location of the outer structure 378 inwardly to connect to the inner structure 382. As shown herein, these plates or frame member 390 connect to vertically extending tubular member 392 which are in turn made part of the outer cylindrical structure 378. If the flotation assembly 370 is to be used as part of a SPAR structure then the tubular members 382 would extend downwardly as in the fifth embodiment to form the main vertical members of the SPAR truss.

Extending between the vertical tubular member 392 are circumferential struts 394 which cooperate with the frame member 390 to provide six circumferential areas or regions in which the flotation tubes 376 are positioned. Thus, with regard to the positioning of the flotation tubes, the arrangement in FIG. 29 is quite similar to that shown in FIG. 23. While the flotation assembly 370 is shown by itself, it is to be understood that this could be incorporated with other structures (such as a SPAR structure, as indicated above).

It is believed that the operation of the flotation assembly 370 is evident from the prior description. Accordingly, this will be covered very briefly in this portion of the text. The outer cylindrical structure 378 obviously serves the function of a shroud simply to protect the tubes from impacts either from waves or various objects.

In addition, the three structural components, namely the upper annular structure 372, the outer cylindrical structure 378 and the inner cylindrical structure 382 are interconnected with one another in a manner to provide an overall structure having adequate structural strength to withstand the impacts and waves and other forces to which the flotation assembly 370 might be subjected. It is evident that the radially interconnecting frame members 390 extending between the inner cylindrical structure 382 and the outer cylindrical structure 392 provide reinforcing and also enable the inner and outer structures 382 and 378 to cooperate with one another in load bearing relationship. Further, these structures 378, 372, and 384 could be compartmentalized so that those portions of the structure 378 and 380 that are under water will provide a flotation force.

Eighth Embodiment

Figure 13:
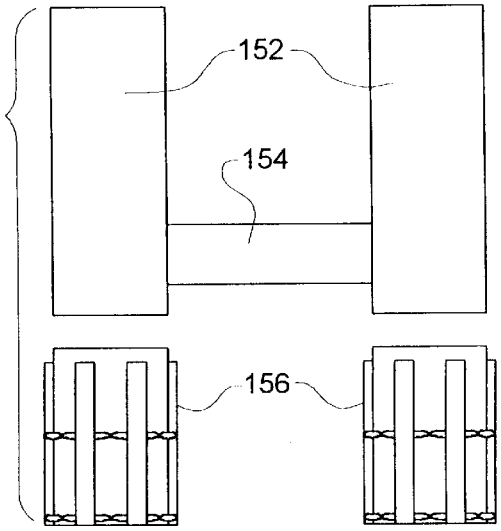
FIG. 13 is a side elevational view of the assembly of FIG. 12.
Figure 31:
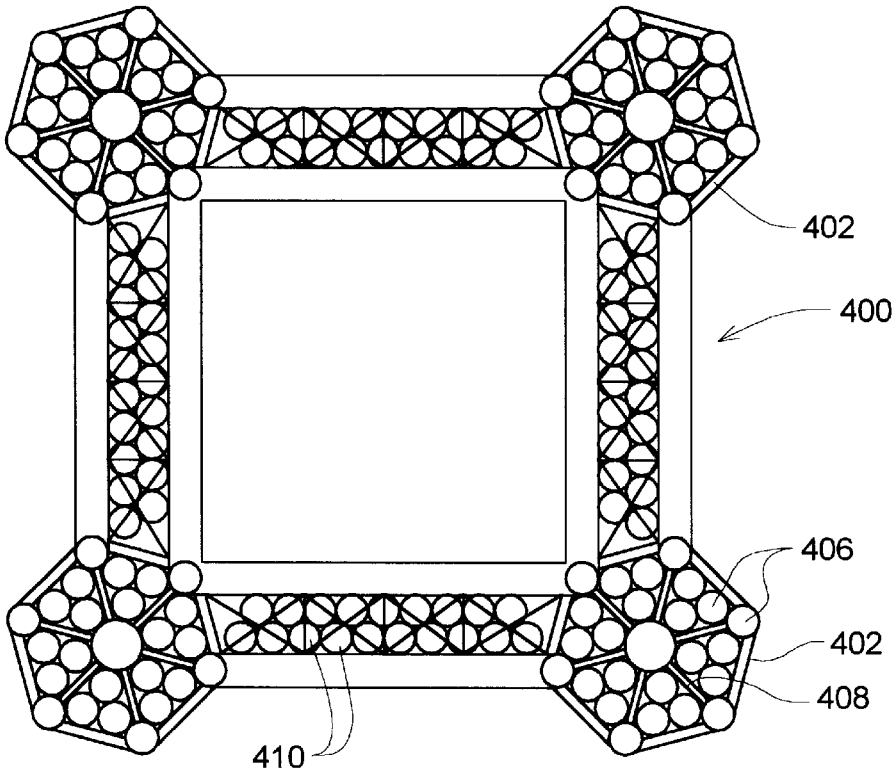
FIG. 31 is a sectional view taken along line 31—31 of FIG. 32, showing an eighth embodiment of the present invention incorporated in a tension leg platform.
Figure 32:
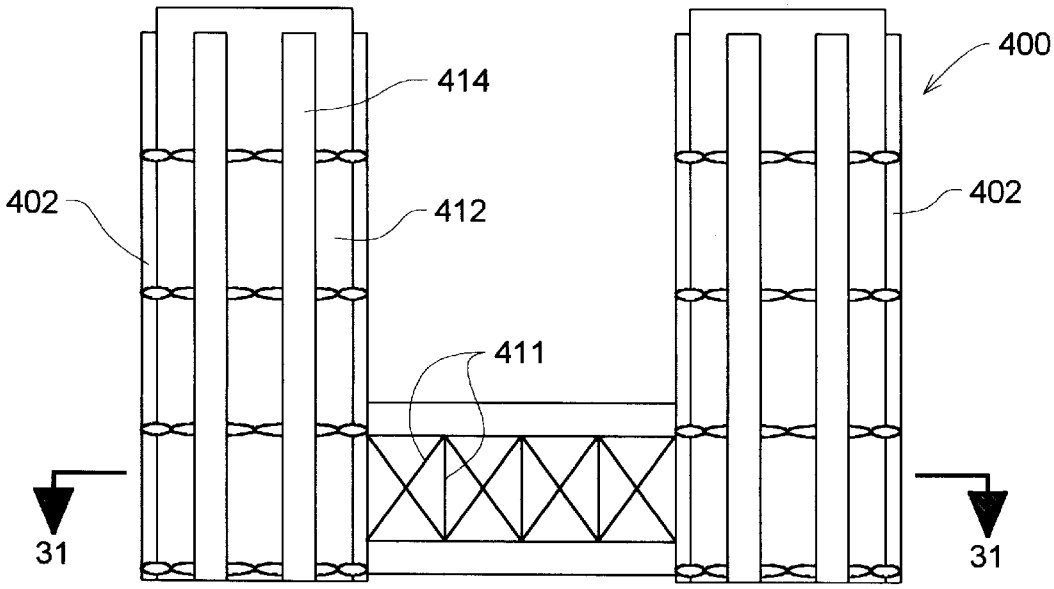
FIG. 32 is an elevational view showing the tension leg platform of the eighth embodiment.

The eighth embodiment of the present invention is shown in FIGS. 31 and 32. This eighth embodiment incorporates the present invention in a tension leg platform, similar to that shown in FIGS. 12 and 13. However, this eighth embodiment differs form the embodiment shown in FIGS. 12 and 13 in that instead of showing a flotation assembly that is provided for the existing tension leg platform the flotation tubes of the present invention are positioned within the structure of the tension leg platform.

As shown in FIGS. 31 and 32 there is a tension leg platform 400 which comprises four legs 402, each having a hexagonal cross-sectional configuration, and four horizontally extending structures 374 interconnecting the legs 402 in a square pattern.

As can be seen in FIG. 31, in each of the legs, there is provided a plurality of flotation tubes 406. It can be seen that the flotation tubes 406 in each leg are arranged in groups and are held in position by a frames 408 which can be similar to the positioning frames described previously herein.

Also, in each of the interconnecting structures 404 there is a plurality of flotation tubes 410. These tubes 410 could also be provided with suitable positioning means to keep these properly aligned and positioned within these structures 404.

The shrouds 412 are best shown in FIG. 32. These shrouds 412 enclose each of the four legs 402, and the shrouds 412 can be provided as described previously in this text. Further, these shrouds 412, in addition to providing the enclosing and protective function, are able to serve as structural members to withstand the various forces imposed on the tension leg platform 400. Further, the positioning frames 408 can be provided in a manner that these connect to the vertical column members 414 in a manner to provide reinforcing.

With regard to the design and functioning of the flotation tubes 406 and 410, in the simplest form these can be provided in the manner of the basic flotation tubes shown at 54*a* and FIG. 6A. Alternatively, other options, such as shown in FIGS. 6B–6G would also be acceptable. For example, the flotation tubes 406 for the legs 402 may more advantageously be designed by having sets of upper and lower tubes. Since these various options have been described previously in this text, these will not be discussed further relative to this seventh embodiment.

Various Design Aspects of the Present Invention

Figure 33A:
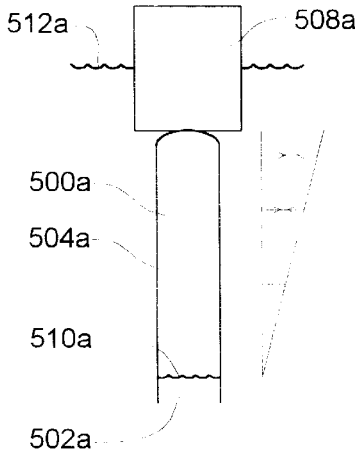
FIGS. 33A through 33H and 33I are schematic drawings drawn in side elevation of various arrangements of flotation tubes, and also illustrating in graphical form the tension loads that are placed on the various configurations.

One of the significant benefits of the present invention is that the flotation tubes can meet a wide variety of requirements. Reference is now made to FIGS. 33A to 33H and 33J which show rather schematically various arrangement. In FIG. 33A there is shown a flotation tube 500*a* which is substantially the same as flotation tube of 54*a* of FIG. 6A. It can be seen that the tube 500*a* has an open bottom end 502*a*. To the right of the tube 500*a* there is shown a diagram illustrating the hoop tension loads imposed on the tube 500*a*. As explained previously, since the air pressure within the chamber 504*a* of the tube 500*a* is substantially the same throughout, and since the water pressure decreases at higher levels, the hoop tension increases along the side wall of the tube 500*a* in an upward direction.

There is a structure 508*a* being supported by the tube 500*a*. The water level in the tube 500*a* is shown at 510*a*, and the water level of the surrounding water is designated 512*a*.

Obviously, this situation requires that as the hoop tension increases, the strength of the side wall of the tube 500*a* must increase correspondingly, either by adding high strength material or simply more of the same material. Alternatively if the tube is to have the same structural characteristics along its entire length, it must be designed to meet the maximum hoop tension requirements the exist at the top end of the tube.

With reference to FIG. 338, there is shown a flotation tube 500*b* which has its length doubled relative to the tube 500*a* of FIG. 33A. There is shown to the right of the tube 500*b* a diagram illustrating the hoop tension. It can readily be seen that at the very top of the tube 500*b* the hoop tension is approximately twice as great as at the top of the tube 500*a*, thus requiring the extra material and/or additional reinforcing to provide additional structural strength. Obviously, there is a practical limit beyond which it is more prudent to select other design options other than simply increasing the length of the tube yet further.

Figure 33B:
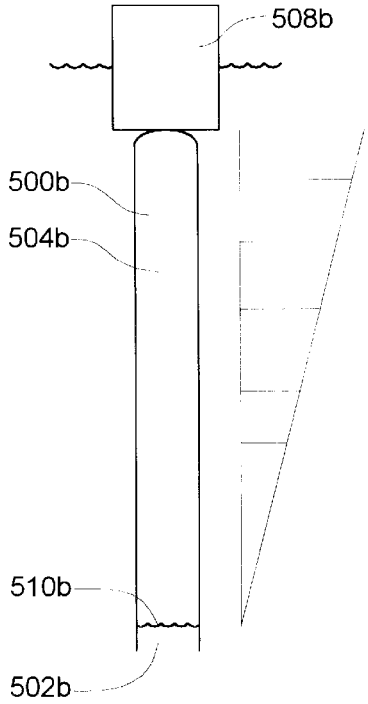
Figure 33C:
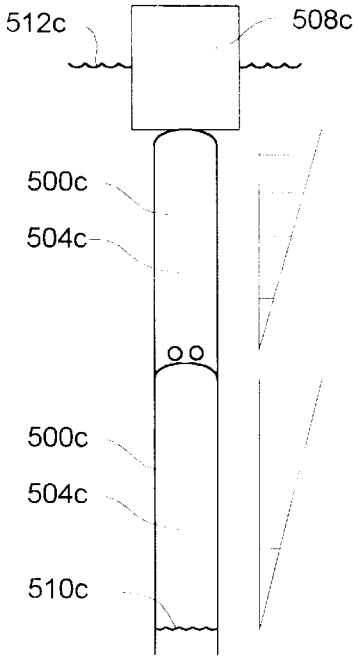

In the arrangement of FIG. 33C we have two tubes 500*c* stacked one on top of the other, with the individual tubes 500*c* having the same length as the tubes 500*a*, but with the two tubes 500*c* stacked one on top of one another having the same length as the tube 500*b*. In this instance, the tubes 500*c* have vent holes 506*c* at the lower end thereof. It can be seen that this is substantially the same arrangement as shown in FIG. 6E or in an alternative design, one or more of the extension tube arrangements such as shown at 96G could be used.

As explained earlier in this text, the lower tube 500*c* could be the same as a tube 500*a*, and a graph illustrating the hoop tension in the lower tube 500*c* is located at the right of FIG. 500*c*. The upper tube 500*c* would have the same hoop tension pattern as the lower tube 500*c*, and this is shown at the right of the upper tube 500*c*. However, with the pressure in the upper tube 500*c* being less than that in the lower tube 500*c*, as explained previously with reference to FIG. 6C, the upper tube 500*c* would be subjected to axial compression loads. Accordingly, in this particular design option, the material selected for the lower tube 500*c* would like to be in a material which has substantial strength to weight ratio in tension (such as fiberglass or other plastics), while the upper tube 500*c* would be made of a material which will withstand not only the loads in hoop tension, but also the axial compression loads. This may dictate that the upper tube 400*c* be made of a metal (such as steel) or other material having such characteristics.

Figure 33D:
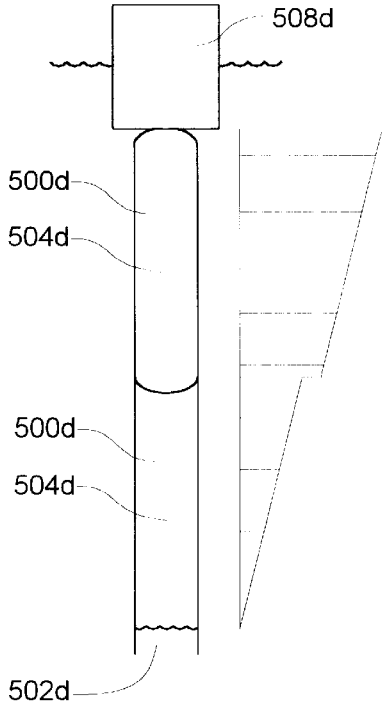

However, as will be apparent skilled in this art, there are other design considerations, such resistance to corrosion, ability to resist shock loads (e.g. impact with some object), ease of installation and/or replacement, maintenance, etc. Thus, some of the tubes may be designed to incorporate a combination of materials where two different materials may be combined for a blend of capabilities, such as providing structural strength with other characteristics, such as resistance to corrosion, etc. Thus there could be a situation where the material providing structural strength would be more susceptible to corrosion, and thus may be incorporated with the surface layer of material more resistant to corrosion, as well as possibly adding structural strength to resist other types of loading, etc. This brings us to the fourth design option of FIG. 33D. The design option shown in FIG. 33D is similar to that shown in FIG. 33C in that there are upper end lower flotation tubes 500*d*, supporting a structure 508. This arrangement is similar to that shown in FIG. 6F in a situation where the upper tube 500*d* is pressurized sufficiently to a high level so that the surrounding side wall of the upper tube is subjected to higher tension loads, and also to either little or no loading axially, or even axial tension loads to ensure that the axial compression loads will not be imposed upon the upper tube 500*b*. As in FIGS. 33A, 33B and 33C, the structure, at 508*d* that is being supported is at the level of the water 512*d*.

The distribution of the tension loads is shown in the graph immediately to the right of the upper and lower tubes 500*d*. As illustrated herein, the pressure in the upper flotation tube 400*d* is sufficiently high so that in addition to the hoop tension loads, the upper tube 400*d* is subjected to a tension force axially.

In FIGS. 33E, 33F, 33G and 33H there is the situation where the structure being supported is above the level of the water.

Figure 33E:
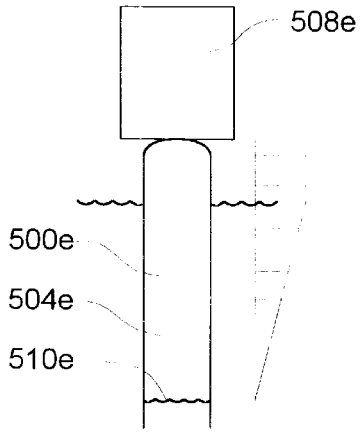

The arrangement shown in FIG. 33E is analogous to that shown in FIG. 33A, and in like manner, the arrangement shown in 33F, 33G and 30H are analogous to, respectively, the arrangement shown in FIGS. 33B, 33C and 33D.

In FIG. 33E, the flotation tube 500*e* has an open bottom 502*e*, and the tube chamber 40*e* has sufficient cross-sectional area and has a base sufficient length so that when the chamber 504*e* is pressurized to a sufficient level, the water level 510*e* in the tube 500*e* is sufficiently low so that the overall buoyancy force (which would be proportional to the difference in the elevation in the water level 512*e* to the surrounding water level at the water surface 512 so that the structure 506*e* is positioned at the desired level above the water surface 512).

The force distribution in hoop tension is illustrated in the graph immediately to the right of the tube 500*e*, and it can be seen that the hoop tension increases from the lower location of the water level 510*e* upwardly to the water surface 512. Then the hoop tension for the upper portion of the upper portion 514*e* of the tube 500*e* that is above the water surface 512*e* remains substantially constant. If a load is imposed on the structure 506*d* to increase the overall weight imposed on the flotation tube 500*e*, then the tube 500*e* would sink lower into the water. However, this would result in an increased buoyancy force since the volume of the air in the chamber 504*e* that is below the level of the water 512*e* would increase. Further, since this would increase the pressure in the chamber 504*e*, the additional pressurized air could be pumped into the chamber 504*e* to maintain the level of the water 510*e* in the tube 500*e* at a low level, relative to the overall length of the tube 500*e* to provide a sufficiently buoyant force. In that instance, the hoop tension in the upper portion of the tube 500*e* would increase to a higher level.

Figure 33F:
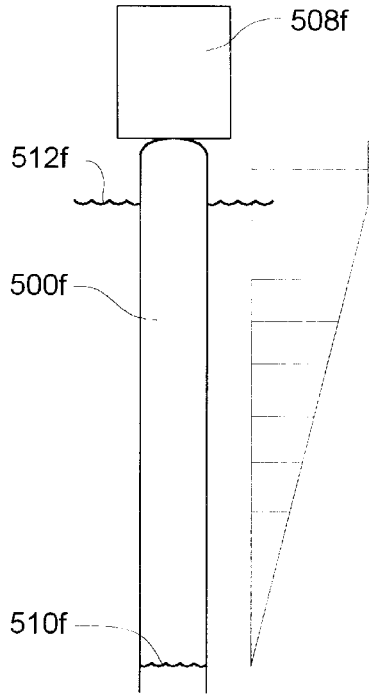

Reference is now made to FIG. 33F, where there is a tube 500*f* that is supporting a load or structure 506*f* which has a greater overall weight, either due to the weight of the structure 506*f* itself or due to added equipment or other items carried by the structure 506*f*. In this instance, the tube 500*f* has the same cross-sectional area as the tube 400*e* of FIG. 33E, but the length of the tube 500*f* is increased. It can be seen that the water level 510*f* in the tube is much lower to increase the overall volume of air in the tube 500*f* and thus increase the buoyancy force.

As shown in FIG. 33F, the structure 508*f* is at a level above the water level 512*f*. However, the elevation of the structure 506*f* can be lowered, simply by reducing the amount of air in the tube chamber 504*f*. As the air is let out of the chamber 504*f* and the structure 506*f* moves to a lower elevation, the water level 510*f* in the tube 500*f* remains nearly the same, since the overall net buoyancy force has, in this instance, decreased only slightly, due to the fact that the greater portion of the lower end portion of the tube 500*f* is surrounded by water both outside and inside the tube so that there is some flotation force exerted by the volume displaced by the tube portion that is immersed (both inside and outside) by water.

It can be seen that from the graph immediately to the right of the tube 500*f* that there is the same pattern of hoop tension distribution as shown in FIG. 33E, but the hoop tension force has increased in the upper portion of the tube 500*f* in comparison with the tube 500*e*.

Figure 33G:
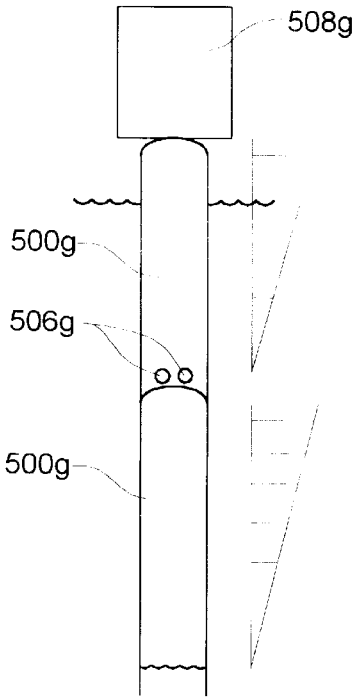

FIG. 33G shows an arrangement which is substantially the same as in FIG. 33C, except that the upper and lower tubes 500*g* are positioned at a higher level so that the upper portion of the upper tube 500*g* is above the water line 512*g*. On the assumption that the two tubes 500*g* are each at the same length as the tubes 500*c*, and also have the same diameter, in order for the upper tube 500*g* to be positioned above the water level 512*g*, the weight of the structure 508*g* plus any load placed thereon would be less than that of the structure 508*g* of FIG. 33C. Also, as shown in the graph immediately to the right of the tubes 500*g* in FIG. 33G, the hoop tension imposed on the lower tube 500*g* is the same as that in the lower tube 500*c* in FIG. 33C. However, the hoop tension imposed on the upper part of the upper tube 500*g* is lower than that imposed on the upper tube 500*c* of FIG. 33C. The pressure level in both of the upper and lower tubes 33G is lower than, respectively, the pressure in the corresponding upper an lower tubes 500*c* shown in FIG. 33C.

Figure 33H:
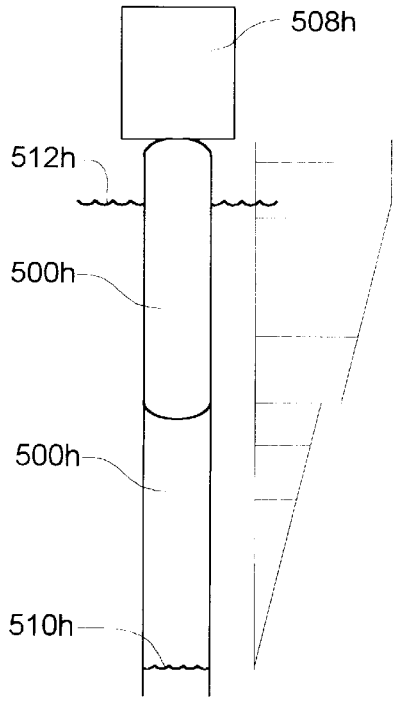
Figure 33I:
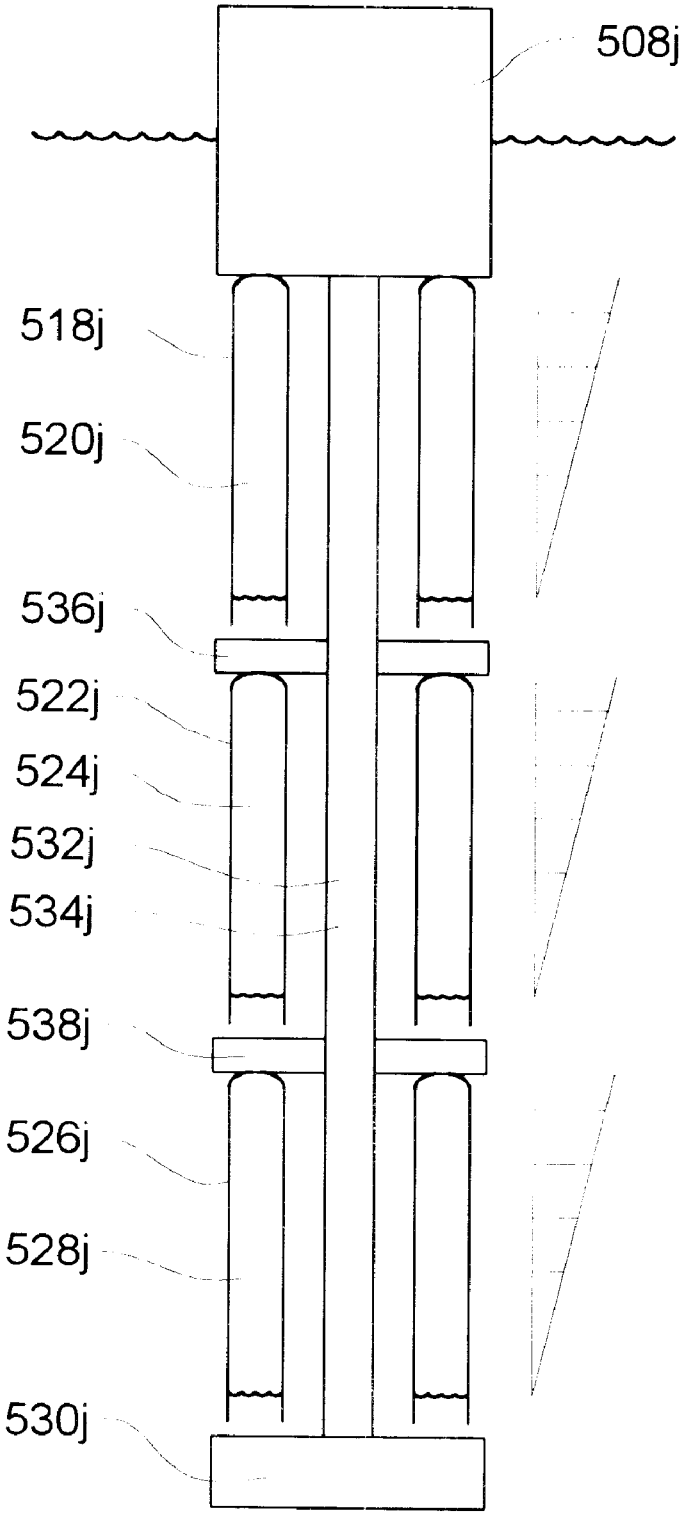

FIG. 33H shows the arrangement similar to that shown in FIG. 33D, except that the tubes 500*h* are located in the water so that the structure 508*h* is above the water level 512*h*. The upper tube 500*h* in FIG. 33H is, as in FIG. 33D, enclosed and pressurized to a sufficiently high level to remove any axial compression loads and actually impose a moderate axial tension load on the upper tube 400*h*.

Thus, there is created the pattern of hoop tension as shown to the right of the tubes 400*h*. On the assumption that the weight of the structure 508*h* and any loads carried thereon increases, then the structure 508*h* and the tubes 500*h* will move to a lower level and the pressures in both of the tubes 500*h* will be increased accordingly to provide the proper support.

Reference is now made to FIG. 33J where there is shown a flotation assembly where there is a group of tubes (three groups in all) arranged one above the other. The underlying design in the assembly of FIG. 33J is similar to that shown in FIG. 28 in that the buoyancy force of each group of tubes are not transmitted from lower tubes directly to upper tubes. Rather these are transmitted through lower and intermediate structural components up through the main structure 508*j* that is being supported. More specifically, in FIG. 33J there is an upper group 518*j* of upper tubes 520*j*, an intermediate group 522*j* of tubes 524*j* and the lower group 526*j* of tubes 528*j*. At the lower end of the assembly there is a ballast section 530*j*.

There is an intermediate load transmitting frame generally designated 532*j*, and this could be in the form of a SPAR frame as described previously herein. In the schematic drawing of FIG. 33J, this interconnecting structure 532*j* is shown as an elongate central member 534*j* that extends from the bottom wall of the structure 408*j* downwardly to connect to the ballast section 530*j*. The upper group 518 of tubes 520 bear directly against the bottom surface of the structure 508*j*; the intermediate group 522*j* of tubes 524*j* bear against an intermediate support structure 536*j* that is fixedly connected to the central interconnecting structural member 534*j*. Then the lowermost group 526*j* of tubes 528*j* bear against a lower low-transmitting structure 538*j* that also is fixedly connected to the central structure for 534*j*.

With regard to the mode of operation of this float assembly in FIG. 33J, each of the tubes 520*j*, 524*j* and 528*j* would have the same force distribution in hoop tension as shown in FIG. 33A. Thus, the buoyancy forces the groups of tubes are separate from one another in terms of load path, with the load paths of the lower groups 522*j* and 526*j* being directed upwardly through the structure 432*j*, and the load path of the uppermost tubes 520*j* being transmitted to the upper structure 508*j*.

It is evident that the various design options which are shown in FIGS. 30A–30H and 30J could be employed in a variety of embodiments, such as those shown previously therein. Also, it is evident that while FIGS. 33A–33H show only a single tube 500 or two tubes 500 are shown in each Figure, there would in most instances be a plurality of such tubes, as shown in various embodiment described previously herein.

Therefore, I claim:

1. A flotation assembly adapted to be positioned in a body of water having a water surface, said assembly comprising:

a) a load bearing structure adapted to be positioned in an operating position at a support location at said body of water, said load bearing structure having a support portion to support a load and a flotation support region at which a flotation lifting force or forces can be applied;

b) a flotation section comprising:

i) a plurality of flotation tubes, each having an upper end portion, a lower end portion, and a longitudinal axis which is aligned so as to have a substantial vertical alignment component;

ii) each flotation tube comprising a surrounding side wall defining an elongate pressure chamber and an upper end closure portion having a downwardly facing pressure surface exposed to pressure in the pressure chamber;

iii) said tubes being positioned at laterally spaced locations and arranged relative to the load bearing structure in a manner that each upper end closure portion of at least some of the flotation tubes operatively directs flotation forces to the load bearing structure to create an upwardly directed bearing force against the load bearing structure;

c) a source of pressurized gaseous fluid to pressurize the flotation tubes to a level where gas pressure within each tube creates a force against said side wall to alleviate at least in part compressive force of surrounding water pressing inwardly against the side walls of the flotation tubes.

2. The flotation assembly as recited in claim 1, wherein the lower end portion of at least one of said flotation tubes is open to ambient pressure of water at the lower end portion of the tube to place at least a portion of said flotation tube above a location at which the flotation tube is open to water in hoop tension.

3. The assembly as recited in claim 1, wherein the lower end portion of at least one of said flotation tubes is at least partially closed, and there is an extension tube extending downwardly from the lower end portion and having a lower end of the extension tube being open to ambient water pressure.

4. The assembly as recited in claim 1, wherein at least one of said flotation tubes is closed at each end to isolate the interior of the chamber of such tubes from direct communication with ambient water pressure.

5. The assembly as recited in claim 4, wherein the tube that is closed at both ends is pressurized to a sufficiently high level so that the tube that is closed at both ends is in hoop tension and also in axial tension to alleviate radially inward compressive loads and axial compression loads.

6. The assembly as recited in claim 1, wherein said source of pressurized gaseous fluid is arranged to pressurize the flotation tubes to a level at least as great as or greater than the water surrounding at least a substantial portion of a substantial number of said flotation tubes to place each of said substantial portions of said tubes in hoop tension along a substantial portion of each flotation tube.

7. The flotation assembly as recited in claim 1, wherein the load support portion of the load bearing structure comprises a load supporting platform having an upwardly facing support surface.

8. The assembly as recited in claim 7, wherein said load bearing structure comprises a hull structure which in an operating position of the assembly in the water is positioned at the water surface and at least in part in a wave impact zone at said water surface, said hull structure further comprising a flotation structure which in the operating position is at least in part below the water surface to provide a buoyancy force in said operating position and having sufficient structural integrity to withstand wave action and/or other external forces imposed thereon when in said operating position.

9. The assembly as recited in claim 8, wherein at least some of said tubes are positioned at circumferntially spaced locations around the hull structure, with upper ends of said some of said tubes being in load bearing relationship to structure that is positioned at circumferential locations around said hull structure to transfer buoyancy force from said some of said tubes to said hull structure.

10. The assembly as recited in claim 8, wherein said flotation tubes comprise an auxiliary flotation support section below said hull structure with at least a substantial portion of said auxiliary support section positioned below said wave impact zone when the assembly is in its operating position, the upper end closure portions of the tubes being in operative load bearing engagement with a lower portion of said hull structure.

11. The flotation assembly as recited in claim 1, wherein the flotation tubes are arranged in at least two groups of said flotation tubes, namely a first upper group positioned beneath said load bearing structure to be in load bearing relationship therewith, and a second group of said flotation tubes being positioned below said first group of flotation tubes, with each group of said flotation tubes exerting a buoyant force to maintain said hull structure in its operating position.

12. The assembly as recited in claim 11, wherein the load bearing structure said a hull structure having a flotation section which is in an operating location beneath the water surface, the first upper group of tubes being positioned below said hull structure.

13. The assembly as recited in claim 11, wherein upper portions of the tubes of the first group extend above the water surface and engage the load bearing structure which is above the water surface.

14. The assembly as recited in claim 13, wherein the tubes of the first group are pressurized to a sufficiently high level so that the tubes of the first group are not subjected to axial compression loads from the load bearing structure.

15. The assembly as recited in claim 13, where the lower ends of the tubes of the first group are open to ambient water pressure with the tubes of the first group withstanding loads from the load bearing structure at least in part in compression loading.

16. The assembly as recited in claim 11, where at least some of the flotation tubes of the first group and from the second group are in direct load bearing relationship where said some of the second group of flotation tubes are in load bearing relationship against related aligned flotation tubes of the first flotation group, whereby the buoyancy force from at least some of said flotation tubes in the second group is directed to the aligned flotation tubes thereabove and to said hull structure.

17. The assembly as recited in claim 11, wherein the flotation tubes from the first group of said flotation tubes that are in alignment with said some of the flotation tubes of the second group have lower end portions thereof open to pressure of ambient water, and the flotation tubes of the first group that are in such alignment are constructed and arranged to bear compression loads between said hull structure and the aligned flotation tubes of the second group.

18. The assembly as recited in claim 1, wherein at least some of the flotation tubes are pressurized to a level so that their side walls are in hoop tension, with the force of the hoop tension increasing with the level portion of the flotation tubes in the water, the side wall of each of said tubes in hoop tension being constructed so that an upper portion of the flotation tubes in hoop tension have greater resistive strength in hoop tension relative to the lower part of said flotation tubes that are in hoop tension.

19. The assembly as recited in claim 18, wherein the flotation tubes that are in hoop tension are constructed of fiberglass, and the fiberglass is arranged relative to material strength, alignment and/or quantity of material in a manner to accomplish greater resistance to hoop tension at upper elevations of said fiberglass flotation tubes than at lower levels of said fiberglass flotation tubes.

20. The flotation assembly of claim 1, wherein said flotation assembly comprises an off-shore platform which comprises a flotation hull that extends above the water surface and also extends below said water surface said hull in its operating position being at least 20 feet above the water surface, and extending at least 20 feet below said water surface.

21. The assembly as recited in claim 1, further comprising a hull structure which is supported by a flotation force of said water, said hull structure having a central opening, said load bearing structure being positioned within the central opening of the hull structure and being able to move vertically relative to the hull structure, whereby the flotation tubes, being in load bearing relationship with the load bearing structure, are able to move with the load bearing structure vertically, relative to the hull structure.

22. The assembly as recited in claim 21, wherein there are additional flotation tubes located beneath the hull structure and are in load bearing relationship with support structure that is in turn connected to the load bearing structure and thus transmit buoyant forces to the load bearing structure.

23. The assembly as recited in claim 1, wherein there is a plurality of groups of said flotation tubes, vertically aligned with one another and spaced vertically from one another, a load transfer structure extending vertically from said load bearing structure downwardly, said load transfer structure having vertically spaced load transfer sections, each of which engages upper end portion of a related group of said tubes, whereby buoyancy forces of each group of tubes is transmitted into related load transfer sections into the load transfer structure and to the load bearing structure.

24. A method of providing flotation support to a load bearing structure, comprising:

a) positioning said load bearing structure in a body of water having a water surface, said load bearing structure having a support portion to support a load and a flotation support region at which a flotation lifting force or forces can be applied;

b) providing a flotation section comprising:

i) a plurality of flotation tubes, each having an upper end portion, a lower end portion, and a longitudinal axis which is aligned so as to have a substantial vertical alignment component;

ii) each flotation tube comprising a surrounding side wall defining an elongate pressure chamber and an upper end closure portion having a downwardly facing pressure surface exposed to pressure in the pressure chamber;

c) positioning said tubes at laterally spaced locations so as to be arranged relative to the load bearing structure in a manner that each upper end closure portion of at least some of the flotation tubes operatively directs flotation forces to the load bearing structure to create an upwardly directed bearing force against the load bearing structure;

d) operating a source of pressurized gaseous fluid to pressurize the flotation tubes to a level where gas pressure within each tube creates a force against said side wall to alleviate at least in part compressive force of surrounding water pressing inwardly against the side walls of the flotation tubes, with bearing force exerted by each end closure portion of each tube being created by gaseous pressure in the related chamber against the end closure portion of each tube.

25. The assembly as recited in claim 16, wherein the flotation tubes of the first group that are in such alignment are open at a location proximate to a lower end portion thereof to ambient water pressure so that at least a portion of said flotation tubes of the first group that are in such alignment is subjected to hoop tension, and the surrounding side walls that are in such alignment are loaded in axial compression to transmit buoyant forces exerted thereon from a tube or tubes from said second group upwardly to the load bearing structure.

26. The assembly as recited in claim 25, wherein at least some of the flotation tubes of the first group that are in such alignment are at least partially closed at lower ends thereof and have an extension extending downwardly from the lower end portions thereof and having a lower end of the extension open to ambient water pressure.

27. The assembly as recited in claim 16, wherein at least one of the flotation tubes from the first group that is in load bearing relationship with a related flotation tube from the second group has its lower end portion closed, and said one of said tubes from said first group is pressurized to a pressure level higher than ambient water pressure at a lower end of said one tube from said first group, thereby alleviating at least to some extent compression loads imposed from the tube from second group positioned immediately below said one tube from said first group.

28. The assembly as recited in claim 16, wherein at least one of the flotation tubes from the first group is pressurized to a pressure level at least as great of pressure in the tube with which it is aligned and in load bearing relationship therewith whereby buoyant force from said tube in load bearing relationship with said one tube from said first group is transmitted as a force into pressurized gaseous fluid in said at least one of said tubes from said first group so that the buoyancy force is imposed at the upper end of said at least one of said tubes of said first group, and axial compression loads are not imposed upon the surrounding side wall of said one tube from said first group.

29. The assembly as recited in claim 16, wherein at least one of said tubes from said second group has at least a partially closed lower end, and an extension tube extending downwardly therefrom, with a lower end thereof being exposed to ambient water pressure, so that said one of said second tubes can be pressurized to a level to cause pressurized gaseous matter to enter into said extension tube.

30. The assembly as recited in claim 1, wherein at least one of said flotation tubes has an interior tubular member positioned within said one of said flotation tubes to extend the entire length thereof and be open at upper and lower ends thereof.

31. The assembly as recited in claim 1, wherein, there is a lower flotation tube positioned in alignment with and below at least one of said flotation tubes and in load bearing relationship therewith so that a buoyancy force from said lower flotation tube is directed to said at least one of said flotation tubes.

32. The assembly as recited in claim 31, wherein said at least one of said flotation tubes is open to ambient water pressure at a lower end thereof, and the surrounding side wall of said at least one of said flotation tubes is configured to withstand the buoyancy force from said lower flotation tube by resisting the buoyancy force from the lower flotation tube in axial compression loading in said at least one of said flotation tubes.

33. The assembly as recited in claim 31, wherein the lower end portion of said at least one of said flotation tubes is at least partially closed, and there is a downward extension from the lower portion of said one of said flotation tubes extending downwardly to a level below a lower end of said at least one of said flotation tubes and open to ambient water pressure so that said at least one of said flotation tubes can be pressurized to a level to cause the gaseous fluid to enter into said downward extension and thus increase ability of said at least one of said flotation tubes to withstand compressive forces exerted thereon from the buoyancy force of the lower flotation tubes.

34. The assembly as recited in claim 31, wherein the lower end portion of said at least one of said flotation tubes is closed, and said at least one of said flotation tubes is pressurized to a pressure level greater than ambient water pressure at the lower end of said at least of one of said flotation tubes, whereby the buoyancy force from the lower tube is withstood at least in part by air pressure in said at least of one of said flotation tubes to alleviate axial loading on said at least one of said flotation tubes.

35. The assembly as recited in claim 31, wherein the low end portion of said at least one of said flotation tubes is closed, and said at least of one of said flotation tubes is pressurized to a sufficiently high level so that the buoyancy force from the lower flotation tube is reacted solely through air pressure upwardly toward the upper end of at least of one of said flotation tubes to alleviate said at least one of said flotation tubes form axial compression loading.

36. The assembly as recited in claim 1, wherein said flotation support region has a downwardly facing support surface, and an upper edge portion of at least one of said flotation tubes is positioned against said a downwardly facing support surface with pressurized fluid in said at least one of said flotation tubes bearing against said downwarldy facing support surface to provide a buoyancy force thereto.

37. The assembly as recited in claim 1, wherein at least one of said flotation tubes has an upper end closure cap, and there is an edge member positioned at a peripheral portion of said closure cap which transmits bearing loads from said closure cap to said load bearing structure.

38. The assembly as recited in claim 37, wherein said edge member is joined to said load bearing structure.

39. The assembly as recited in claim 1, wherein at least one of said flotation tubes has an upper end cap to close the upper end of said at least one of said flotation tubes, and there is a bearing member positioned at a central portion of said end closure cap, and fluid pressure within said at least one of said tubes is transmitted to said closure cap which in turn transmits these loads to the bearing member, that in turn transmits the forces from the pressure within said at least one of said tube as an upward force to said load bearing structure.

40. The assembly as recited in claim 1, wherein a group of said flotation tubes are arranged in a flotation module which comprises positioning structure to maintain the flotation tubes of the group in proper position relative to one another.

41. The assembly as recited in claim 40, wherein said flotation module comprises an upper bearing member to which buoyant forces of the flotation modules in the group are transmitted, with the bearing member in turn having a load bearing relationship with the load bearing structure.

42. The assembly as recited in claim 40, wherein said flotation module is constructed and configured so that said flotation module can be constructed at one location and is capable of being shipped to a location of said assembly and placed into operating location in said assembly.

43. The assembly as recited in claim 40, wherein there is a surrounding side wall which extends around at least some of said flotation tubes as an outer protective shroud.

44. The assembly as recited in claim 43, wherein said protective shroud is water tight and is able to accept pressurized gaseous fluid therein, said shroud being arranged to contain said pressurized fluid in a manner to exert a buoyancy force toward the load bearing structure.

45. The assembly as recited in claim 43, wherein said flotation tubes are arranged so as to provide a central opening in said flotation section, said assembly further comprising a wall extending around said central opening and positioned at a location of said flotation tubes to function as an inner protective shroud for said flotation tubes.

46. The assembly as recited in claim 45, wherein said outer shroud and said inner shroud are water impervious, said assembly also arranged to provide for pressurizing a region between said inner and said outer shrouds to create an added buoyancy force for support structure.

47. The assembly as recited in claim 8, wherein said flotation support region is at a lower portion of said hull structure, and said plurality of flotation tubes are positioned beneath said hull structure and at least partly in a quiescent zone beneath said wave impact zone.

48. The assembly as recited in claim 47, wherein the upper portions of at least some of said flotation tubes are at an elevation no higher than about 30 feet below water line of said hull structure and are positioned beneath said hull structure.

49. The assembly as recited in claim 48, wherein at least some of said flotation members are located beneath said hull structure and are enclosed in a surrounding shroud extending around said at least upper portions of some of said flotation tubes.

50. The assembly as recited in claim 1, wherein said source of pressurized gaseous fluid further comprises a flow control system to provide flow of gaseous fluid selectively to at least some of said flotation tubes.

51. The assembly as recited in claim 50, wherein said flotation tubes are positioned at laterally spaced locations beneath said load bearing structure, whereby a compressed gaseous fluid is able to be directed selectively to said flotation tubes in a manner to selectively distribute, increase, or decrease buoyant forces for said load bearing structure.

52. The assembly as recited in claim 1, wherein said load bearing structure comprises a tension leg platform structure comprising a plurality of vertically aligned legs spaced from one another and interconnecting structures interconnecting said vertically aligned legs, said flotation tubes being located in load bearing relationship with at least some portions of said load bearing structure.

53. The assemble as recited in claim 52, wherein at least some of said flotation tubes are located within at least some of the legs of the tension leg platform structure.

54. The assembly as recited in 52, wherein at least some of the flotation tubes are positioned at the interconnecting structures to provide a buoyancy force to said interconnecting structures.

55. The assembly as recited in claim 52, wherein at least some of said flotation tubes are positioned below at least some of the vertically aligned legs.

56. The assembly as recited in claim 1, wherein said flotation assembly comprises a SPAR assembly wherein said load bearing structure is a hull structure, and there is a truss section connected to and extended downwardly from said hull structure with a ballast section at a lower end portion of the truss section, said flotation section being positioned at least partly within an upper portion of said truss section and below said hull structure.

57. The assembly as recited in claim 56, wherein there is positioning structure to properly position said flotation tubes, and said positioning structure has at least in part operative connections between said truss structure and said flotation tubes.

58. The assembly as recited in claim 1, wherein said load bearing structure has a central opening, and said load bearing structure surrounds said central opening, said flotation section being positioned below said load bearing structure and comprising a plurality of groups of flotation tubes positioned at spaced locations circumferentially relative to said central opening, said flotation section further comprising a positioning frame structure locating said groups of flotation tubes.

59. The flotation assembly as recited in claim 58, wherein said flotation section has a central through opening aligned with the central opening of the load bearing structure.

60. The assembly as recited in claim 1, further comprising a hull structure which is supported by a flotation force of said water, said hull structure having a central opening, said load bearing structure comprising a riser structure positioned in the central opening of the hull structure and arranged to be able to move vertically relative to the hull structure, said riser structure comprising a central structural section extending downwardly through the central opening of the hull structure, and a lower structure surrounding said central structure and extending laterally outwardly beneath said hull structure, at least some of said flotation tubes being positioned beneath said lower structure to transmit buoyancy force through said lower structure and through said central structure.

61. The assembly as recited in claim 11, wherein at least some of said flotation tubes are arranged in at least two groups of said flotation tubes, namely a first upper group positioned beneath said load bearing structure to be in load bearing relationship therewith, and a second group of said flotation tubes being positioned below said first group of flotation tubes, with each group of said flotation tubes exerting a buoyant force to maintain said hull structure in its operating position, said water having a wave impact zone, at least upper portions of said first group of flotation tubes extending upwardly into said impact zone, said assembly further comprising surrounding structure surrounding at least portions of the first group located in the impact zone said surrounding structure having sufficient structural strength to withstand forces in the wave impact zone.

62. The assembly as recited in claim 61, wherein the upper end portions of said first group of flotation tubes extend to a level above the water surface of said body of water.

63. The assembly as recited in claim 1, wherein said assembly further comprises a SPAR structure where the load bearing structure and the flotation section comprise an upper SPAR flotation section, and there is a SPAR truss extending downwardly from said upper SPAR flotation section, at least some of said flotation tubes having at least the upper end portions thereof being positioned in a wave impact zone of the body of water in which the SPAR section is positioned.

64. The assembly as recited in 63, wherein said truss section comprises a plurality of vertical structural members extending from a lower end of the truss section upwardly to connect to said load bearing structure, with at least some of said flotation tubes being positioned in an area within said vertical structural members.

65. The assembly as recited in claim 63, further comprising an upper surrounding structure located in the wave impact zone and extending around portions of the flotation tubes located in said wave impact zone.

66. The assembly as recited in claim 63, wherein said flotation tubes are arranged in two groups, namely an upper group located proximate to the load bearing structure, and a second group being positioned below said first group.

67. The assembly as recited in claim 1, wherein said load bearing structure comprises an upper load bearing structure portion having a surrounding edge portion, and an outer load bearing structure portion connected to and extending downwardly from the edge portion of the upper load bearing structure portion, said upper load bearing structure portion and said outer load bearing structure portion defining a flotation region beneath said upper load bearing structure portion and within said outer load bearing structure portion, at least some of said flotation tubes being positioned within said flotation region.

68. The assembly as recited in claim 67, further comprising structural members positioned within said flotation region and extending between wall portions of said load bearing structure.

69. The assembly as recited in claim 67, wherein said upper load bearing structure portion has a central opening, said assembly further comprising a central structure having an upper end portion at a central part of said upper load bearing structure and extending downwardly therefrom to be positioned around the central opening of the upper load bearing structure.

70. The assembly as recited in claim 69, comprising reinforcing structure extending between said outer load bearing structure portion to said central structure.

71. The assembly as recited in claim 70, wherein said reinforcing structure extends generally at least in part radially between the outer load bearing structure portion and the central structure, with the flotation tubes being positioned at locations between portions of the reinforcing structure.

72. The assembly as recited in claim 1, where at least some of said flotation tubes have a substantially uniform circular cross sectional configuration and are substantially vertically aligned in said assembly.

73. The assembly as recited in claim 72, wherein said at least some of said tubes are made at least in part from fiberglass, with said fiberglass being structured so as to provide substantial resistance to loading in hoop tension.

74. The method as recited in claim 24, further comprising pressurizing at least some of said flotation tubes to a sufficient level to place said at least some of said flotation tubes at least partly in hoop tension.

75. The method as recited in claim 24, wherein there is sufficient gaseous pressure in at least some of said tubes to alleviate potential axial compression loads in said at least on some of said tubes so that the flotation forces provided by said at least some of said tubes is substantially solely from gaseous pressure in said at least some of said tubes acting through said end closure portions of said at least some of said tubes.

76. The method as recited in claim 24, wherein at least some of said tubes are grouped together as a tube assembly at an assembling location, and then moving said tube assembly to a location of said load bearing structure and then placing said tube assembly in said operating position.

77. The method as recited in claim 24, further comprising bringing at least one of said tubes to the location of said bearing structure, filling said at least one of said tubes at least partially with water, then moving said at least one of said tubes to the operating location, after which the gaseous medium is pumped into the pressure chamber of said at least one of said tubes.

78. The method as recited in claim 24, further comprising directing the pressurized gaseous fluid into the tubes to provide greater or lesser volume of the gaseous fluid in the tubes in a manner to provide the buoyancy forces at a proper magnitude to support loads imposed on the load bearing structure.

79. The method as recited in claim 24, further comprising selectively directing the pressurized gaseous medium into selected ones of the flotation tubes to stabilize the load bearing structure, depending upon distribution of loads thereon.

80. A flotation tube particularly adapted to be used in a flotation section of a flotation assembly which is adapted to be positioned in a body of water having a water surface, where said assembly comprises a load bearing structure adapted to be positioned in an operating position at a support location at said body of water, where said load bearing structure has a load support portion to support a load and a flotation support region at which a flotation lifting force or forces can be applied and where the flotation tube is one of a plurality of flotation tubes positioned at laterally spaced locations and arranged relative to the load bearing structure in a manner to provide flotation forces to the load bearing structure to create an upwardly directed bearing force against the load bearing structure and there is a source of pressurized gaseous fluid to pressurize the flotation tubes, said flotation tube having an upper end portion, a lower end portion, and a longitudinal axis, and comprising a surrounding side wall defining an elongate pressure chamber having a pressurized gas containing region, said flotation tube having an upper end closure portion having a downwardly facing pressure surface positioned to be exposed to pressure in the pressure chamber, and being constructed with sufficient structural strength to be able to exert a buoyancy force related to a volumetric portion of the pressure chamber filled with pressurized gas, so that the buoyancy force of the flotation tube can be transmitted to the load bearing structure, said side wall having a substantially uniform circular cross sectional configuration so that force of gaseous pressure in said pressure chamber is reacted into said side wall substantially in hoop tension, and being constructed along at least a substantial portion of said side wall to be able to withstand said force of gaseous pressure in hoop tension, the lower end of the flotation tube being at least partially open to ambient water so that the quantity of gaseous fluid in the pressure chamber can be increased or decreased to cause water to discharged from or flow into said pressure chamber to increase or decrease said volumetric portion of the pressure chamber filled with pressurized gas, and thus correspondingly increase or decrease pressure in said chamber to correspondingly increase or decrease the buoyancy force exerted by the flotation tube whereby said flotation tube is able to have water flow into said pressure chamber so that the flotation tube can be positioned in the body of water in an operating position in the flotation assembly, and a gaseous fluid under pressure can then be injected into said pressure chamber to move water in the pressure chamber out of said pressure chamber so that the pressure chamber is able to exert said buoyancy force against said end closure member.

81. The flotation tube as recited in claim 80, wherein the lower end portion is at least partially closed, and there is an extension tube extending from said flotation tube with an end of the extension tube being exposed to ambient water pressure.

82. The flotation tube as recited in claim 80, wherein the lower end portion of the flotation tube is at least partially closed, and there is a downward extension from the flotation tube extending downwardly to a level below a lower end of said flotation tube and having open to ambient water pressure so that said flotation tube can be pressurized to a level to cause gaseous fluid to enter into said downward extension and thus increase ability of said flotation tube to withstand axial loading.

83. The flotation tube as recited in claim 80, wherein said flotation tube has an interior tubular member positioned within said flotation tube to extend the length thereof and be open at upper and lower ends thereof.

84. The flotation tube as recited in claim 80, wherein the surrounding sidewall of the flotation tube is constructed so as to withstand axial loading in addition to loads in hoop tension, whereby the flotation tube can provide a buoyancy force, and also transmit axial loads.

85. The flotation tube as recited in claim 80, wherein said surrounding sidewall of said flotation tube is made at least in part by fiberglass with said fiberglass being structured so as to provide substantial resistance to loading hoop tension.

86. The flotation tube as recited in claim 80, wherein said flotation tube has an upper end closure cap, and there is an edge member positioned at a peripheral portion of said end closure cap which transmits bearing loads from the closure cap upwardly.

87. The flotation tube as recited in claim 80, wherein the flotation tube has an upper end closure cap, and there is a bearing member positioned at a central location of said closure cap wherein loads transmitted to said closure cap are in turn transmitted to said bearing member.

88. The flotation tube as recited in claim 80, wherein the sidewall of the flotation tube is arranged so that at least one upper portion of said side wall is better able to withstand larger hoop tension loads than at least one lower portion of said flotation tube.

89. The flotation tube as recited in claim 80, wherein said flotation tube is made at least in part of metal.

* * * * *